US006364017B1

(12) United States Patent
Stout et al.

(10) Patent No.: US 6,364,017 B1
(45) Date of Patent: Apr. 2, 2002

(54) SINGLE TRIP PERFORATE AND GRAVEL PACK SYSTEM

(75) Inventors: Gregg W. Stout, Montgomery, TX (US); James T. Matte, Broussard, LA (US)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 09/510,317

(22) Filed: Feb. 22, 2000

Related U.S. Application Data

(60) Provisional application No. 60/121,594, filed on Feb. 23, 1999.

(51) Int. Cl.[7] ..... E21B 43/04

(52) U.S. Cl. ..... 166/278; 166/51; 166/55.1; 166/125; 166/181; 166/297

(58) Field of Search ..... 166/51, 278, 297, 166/55.1, 120, 125, 181

(56) References Cited

U.S. PATENT DOCUMENTS

| | | | | |
|---|---|---|---|---|
| 4,372,384 A | | 2/1983 | Kinney | 166/278 |
| 4,566,538 A | | 1/1986 | Peterson | 166/278 |
| 4,858,690 A | | 8/1989 | Rebardi et al. | 166/278 |
| 4,969,524 A | | 11/1990 | Whiteley | 166/278 |
| 5,180,010 A | | 1/1993 | Stout et al. | 166/212 |
| 5,255,741 A | | 10/1993 | Alexander | 166/278 |
| 5,332,038 A | | 7/1994 | Tapp et al. | 166/278 |
| 5,343,949 A | * | 9/1994 | Ross et al. | 166/278 |
| 5,413,180 A | | 5/1995 | Ross et al. | 166/387 |
| 5,462,117 A | | 10/1995 | Green et al. | 166/297 |
| 5,577,559 A | | 11/1996 | Voll et al. | 166/278 |
| 5,579,844 A | | 12/1996 | Rebardi et al. | 166/296 |
| 5,842,528 A | | 12/1998 | Johnson et al. | 175/45 |
| 5,845,712 A | | 12/1998 | Griffith, Jr. | 166/278 |
| 5,865,251 A | | 2/1999 | Rebardi et al. | 166/278 |
| 5,921,318 A | | 7/1999 | Ross | 166/250.17 |
| 5,931,229 A | | 8/1999 | Lehr et al. | 166/278 |
| 5,975,205 A | | 11/1999 | Carisella | 166/278 |

FOREIGN PATENT DOCUMENTS

| | | | |
|---|---|---|---|
| GB | 2300440 A | 11/1996 | E21B/23/06 |
| GB | 2343694 | 5/2000 | E21B/23/06 |

* cited by examiner

*Primary Examiner*—David Bagnell
*Assistant Examiner*—Zakiya Walker
(74) *Attorney, Agent, or Firm*—Howrey Simon Arnold & White

(57) ABSTRACT

An improved single trip perforating and gravel pack system is provided which includes a tubing conveyed perforating assembly, a gravel pack completion assembly, and a retrievable service assembly. The retrievable service assembly includes a hydraulic setting tool and a crossover tool assembly. The hydraulic setting tool is less sensitive to hydraulic pressures generated by the detonation of the perforating guns. The hydraulic setting tool includes an annulus release mechanism, a preset lock assembly and a rotational lock assembly, all of which are mechanically actuated. The retrievable service assembly also includes a concentric check valve which improves well control and allows for reversing out excess slurry in the service assembly following completion of a gravel packing or frac packing operation.

33 Claims, 21 Drawing Sheets

SINGLE TRIP PERFORATE AND GRAVEL PACK SYSTEM

This application claims the benefit of U.S. Provisional Application No. 60/121,594, filed Feb. 23, 1999, the specification of which is hereby incorporated by reference.

BACKGROUND OF THE INVENTION

1. Field of the Invention

This invention relates generally to the field of completing oil and gas wells and, more particularly, to a single trip system for perforating and gravel (or frac) packing a wellbore section. The system includes a unique hydraulic setting tool which is less sensitive to the hydraulic shocks generated from the detonation of the system's tubing conveyed perforating guns than setting tools for previous single trip systems. A preferred embodiment of the system also utilizes a pump down shifting tool which mechanically unlocks the hydraulic setting tool so that the gravel pack packer may be set in the desired location. The service assembly of the system may include a concentric check valve in the service assembly for use when reversing out excess slurry following the completion of the gravel (or frac) pack operations.

2. Description of the Related Art

Single trip perforating and gravel pack systems have been available in the oil industry since at least the 1980's. The detonation of the perforating guns create high shock loads which may adversely effect the rest of the system. Following detonation of the guns, rapidly expanding gas and displaced fluid around the perforating guns combine to create a hydraulic shock wave that travels at approximately 24,000 feet per second. The hydraulic shock wave travels through both the perforating and gravel packing system as well as the annulus around the system. These shock waves can cause numerous problems including prematurely setting the gravel pack packer at the wrong location in the wellbore and prematurely activating the annulus release mechanism which releases the service assembly from the gravel pack packer. Either of these and other possibly undesirable events may cause expensive fishing trips and/or multiple trips into the wellbore to remove and replace the perforating and gravel pack system.

Single trip perforating and gravel packing systems include a tubing conveyed perforating assembly, a gravel pack completion assembly, which includes a gravel pack packer, and a service assembly which includes a hydraulic setting tool for setting the gravel pack packer and a crossover tool assembly for conducting the gravel pack operations. Prior art hydraulic setting tools typically included an annulus release mechanism which utilized annulus pressure on the backside of the gravel pack packer to release the service assembly from the packer after the gravel pack packer had been set. The annulus release mechanism of the prior art setting tool included a piston which was separate and apart from the setting piston for the gravel pack packer. Thus, there was a risk that the hydraulic shock wave from the detonation of the perforating gun would actuate the hydraulic annulus release tool and prematurely release the service assembly from the gravel pack packer before the latter had been set.

The prior art setting tools also included a second hydraulic piston which hydraulically actuated a rotational lock between the service assembly and the gravel pack packer. This piston also actuated a preset lock feature that kept locking keys engaged with the setting sleeve of the packer. When this piston was shifted by hydraulic pressure, it unlocked the preset locking device on the hydraulic setting tool in order to commence setting the gravel pack packer. The piston also unlocked the rotational lock between the service assembly and packer assembly. This second piston was also susceptible to the hydraulic shock loads generated from the detonation of the perforating guns which could cause the premature release of the preset and rotational locks.

The present invention is directed to overcoming, or at least reducing the effects of, one or more of the problems set for above. More particularly, the present invention has eliminated the separate hydraulic actuating pistons for the annulus release mechanism, the rotational lock and the preset lock device. The preferred embodiment of the hydraulic setting tool for the present invention includes an annulus release, a preset lock and a rotational lock. These features, however, are now mechanically actuated instead of hydraulically actuated. In addition, the present system mechanically locks the various assemblies in position so that the system will be more resistant to the shock waves generated by the detonation of the perforating guns. This is accomplished by shear pinning the mechanical components at higher values than traditionally used to better withstand the hydraulic shock wave traveling up both the annulus as well as the system itself.

SUMMARY OF INVENTION

An improved single trip perforating and gravel pack system is provided which includes a new hydraulic setting mechanism which is less sensitive to hydraulic pressures generated by the detonation of the perforating guns. Most hydraulic pistons have been eliminated from the hydraulic setting tool for the gravel pack packer which would normally be sensitive to hydraulic shocks generated from the perforating gun detonation. The annulus release mechanism of the service assembly operates off the packer setting piston rather than a separate annulus pressure sensitive piston. By working off the large setting piston, it is possible to shear pin components of the system at high shear values to withstand the severe shock loads created by perforating. The system also includes a mechanical lock sleeve which is preferably pressure balanced, includes no o-ring seals, and mechanically keeps the gravel pack packer from prematurely setting. The system utilizes a pump down shifting tool to engage and shift the lock sleeve to the unlocked position so the setting tool may begin setting the gravel pack packer. The pump down shifting tool is adapted to be permanently locked in place below the gravel flow ports after the lock sleeve has been shifted to the unlocked position. A double cup design may be used to insure that the shifting tool is pumped past the elongated gravel flow ports without partially blocking the ports at any time.

The preferred embodiment of the system is also designed to allow circulation from the workstring all the way through the gravel pack screens and out a circulating sub above the perforating guns prior to setting the service packer. The system includes a full opening internal diameter to the firing head so a detonating bar may be dropped to fire the perforating guns. A secondary firing system may also be used which is actuated by tubing pressure to hydraulically fire the perforating guns. In order the transfer tubing pressure to a hydraulic firing head, a sliding sleeve in the completion assembly is run in the closed position. The sleeve is later opened prior to commencing gravel packing operation to create a flow path from inside the service assembly, through the completion assembly, to the annulus below the gravel pack packer. The sliding sleeve is opened by engaging the sleeve with a shifting tool in the service assembly and shifting the sliding sleeve to the open position.

A preferred embodiment of the present invention incorporates a concentric check valve in the service assembly which improves well control and allows for reversing out excess slurry in the service assembly following completion of a gravel packing operation. Due in part to the configuration of the concentric check valve, the service assembly has an open internal diameter throughout which permits circulation of fluids through the service assembly, as well as the ability to drop a detonating bar or apply hydraulic pressure to the firing head for the perforating guns.

BRIEF DESCRIPTION OF THE DRAWINGS

Other objects and advantages of the invention will become apparent upon reading the following detailed description and upon reference to the drawings in which.

Figure 1A:
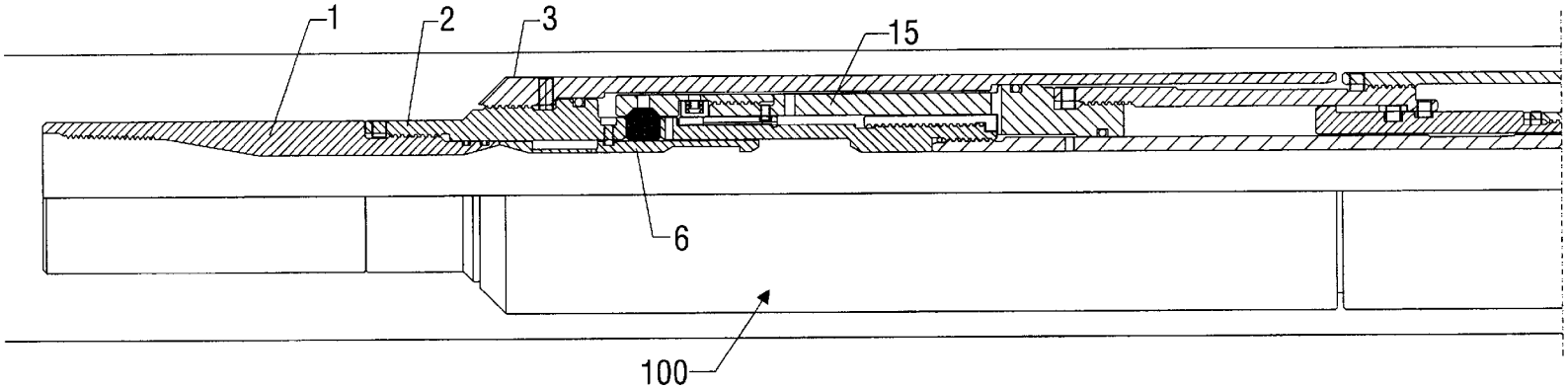
FIGS. 1A–1J are cross-sectional views of a preferred embodiment of the single trip perforating and gravel pack system.
Figure 1B:
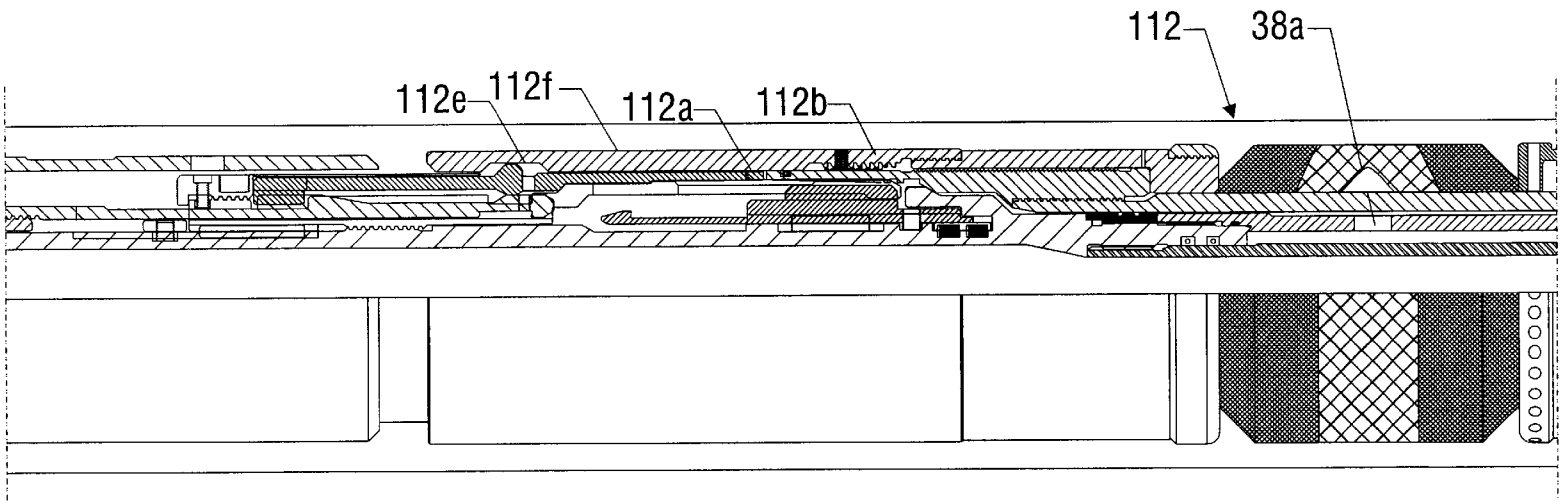
Figure 1C:
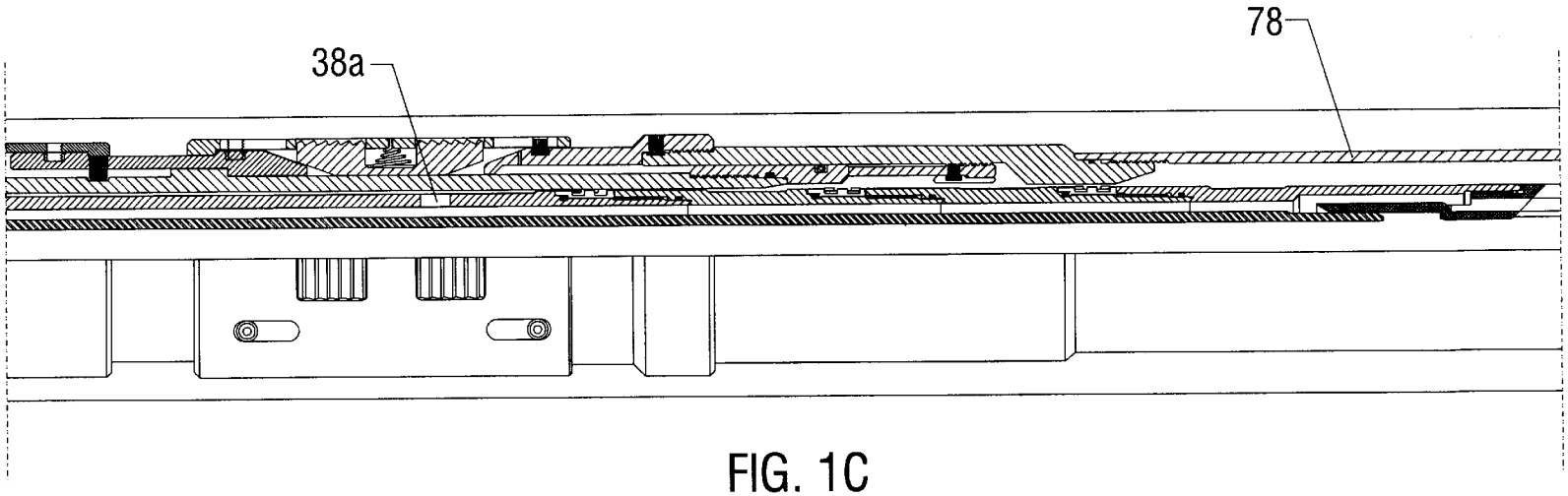
Figure 1D:
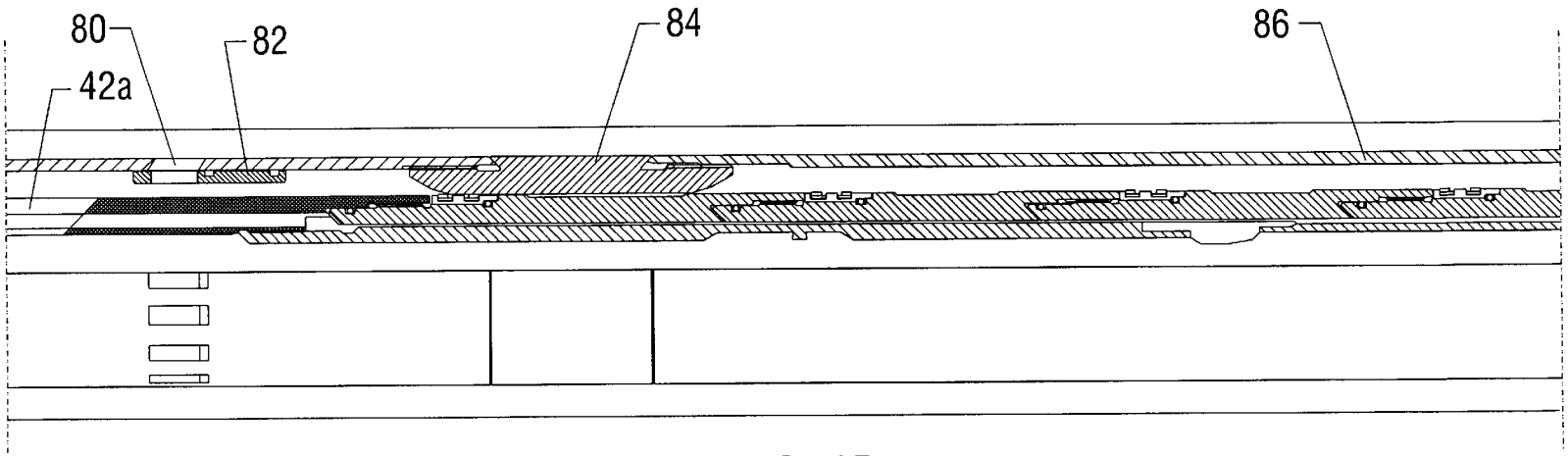
Figure 1E:
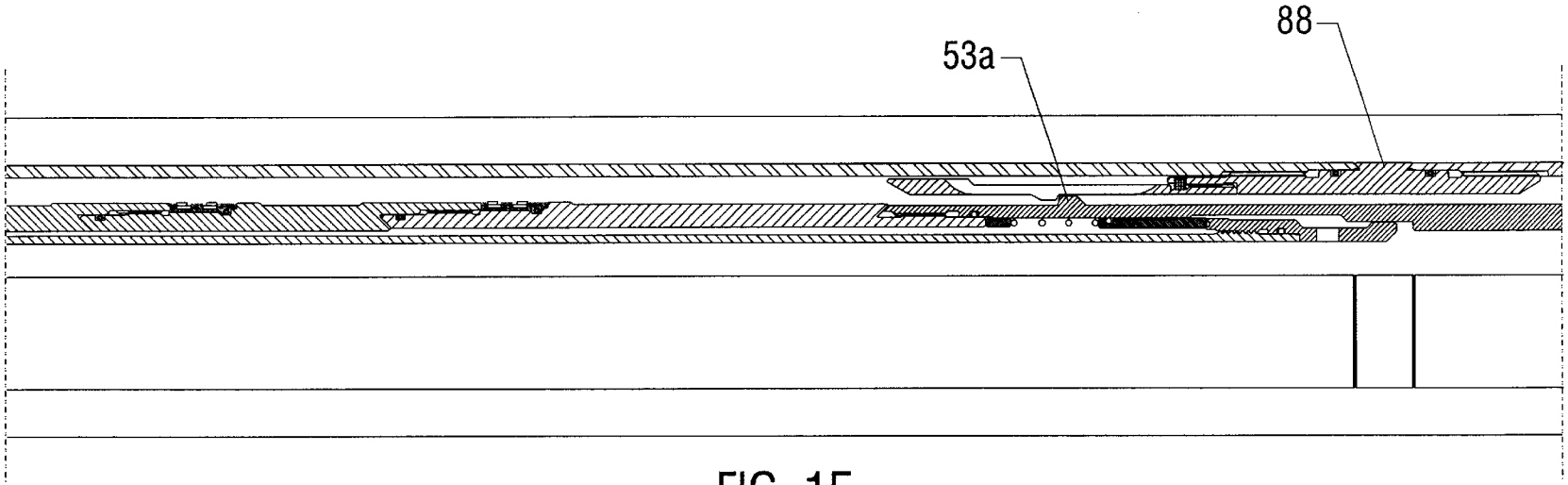
Figure 1F:
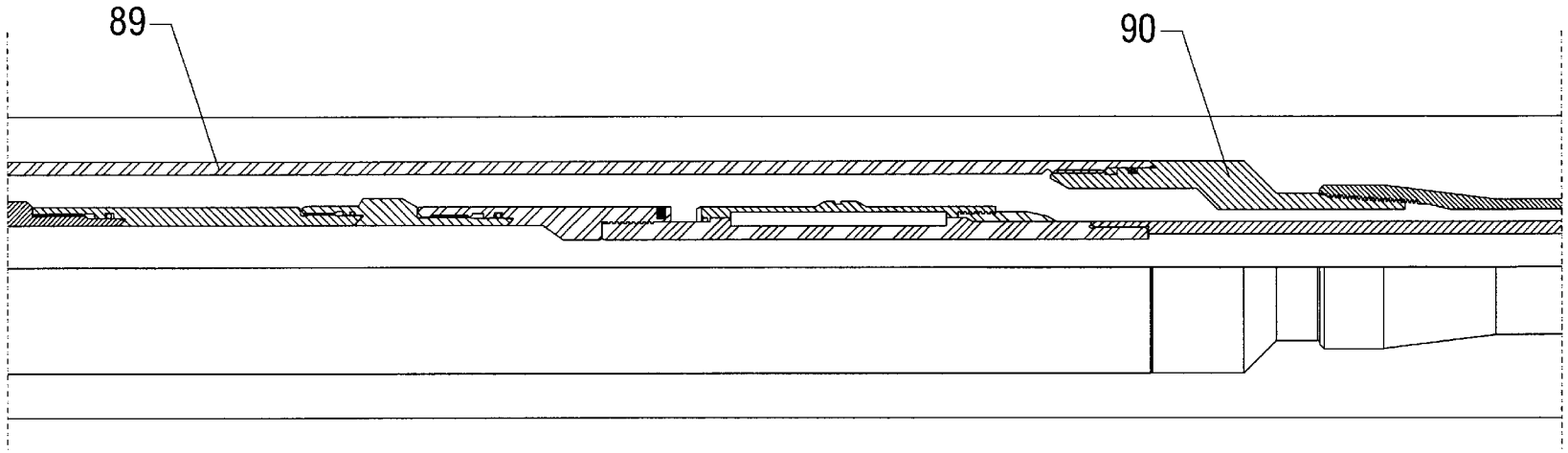
Figure 1G:
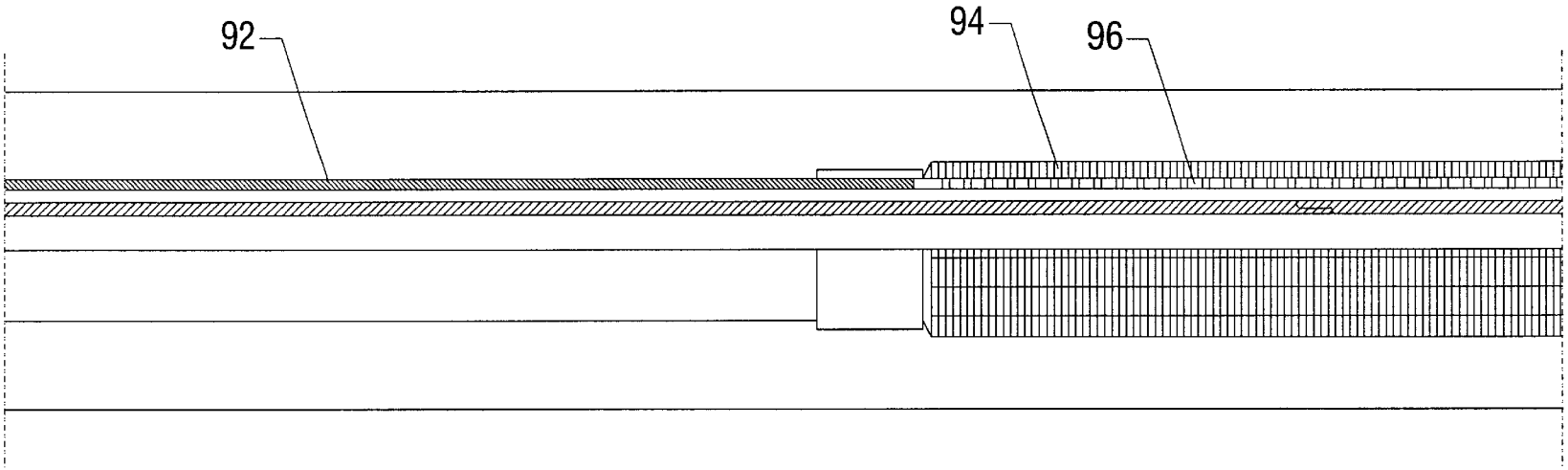
Figure 1H:
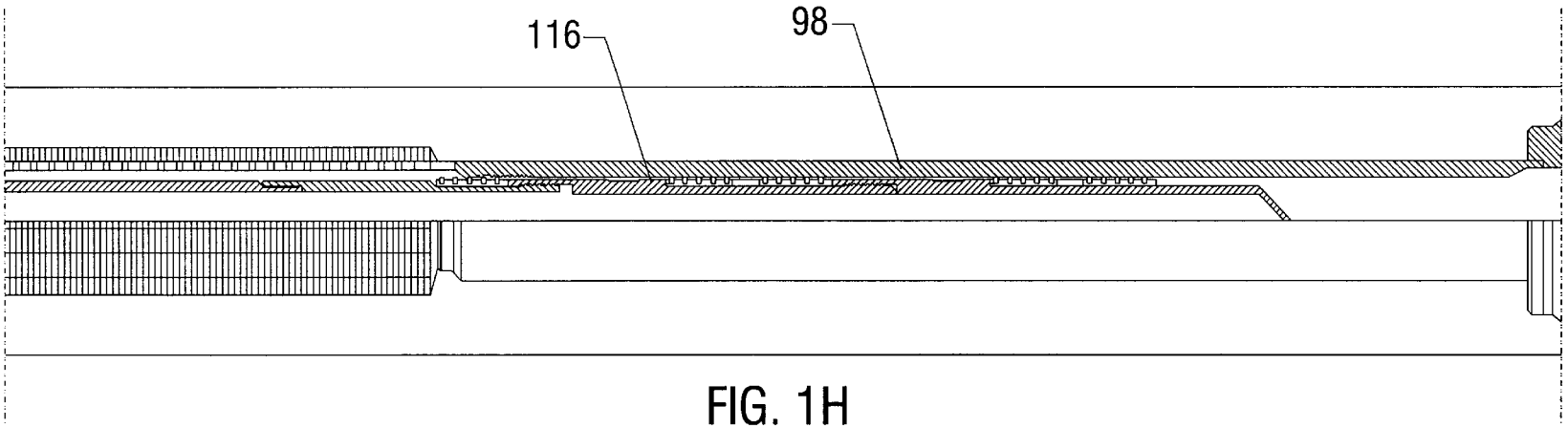
Figure 1I:
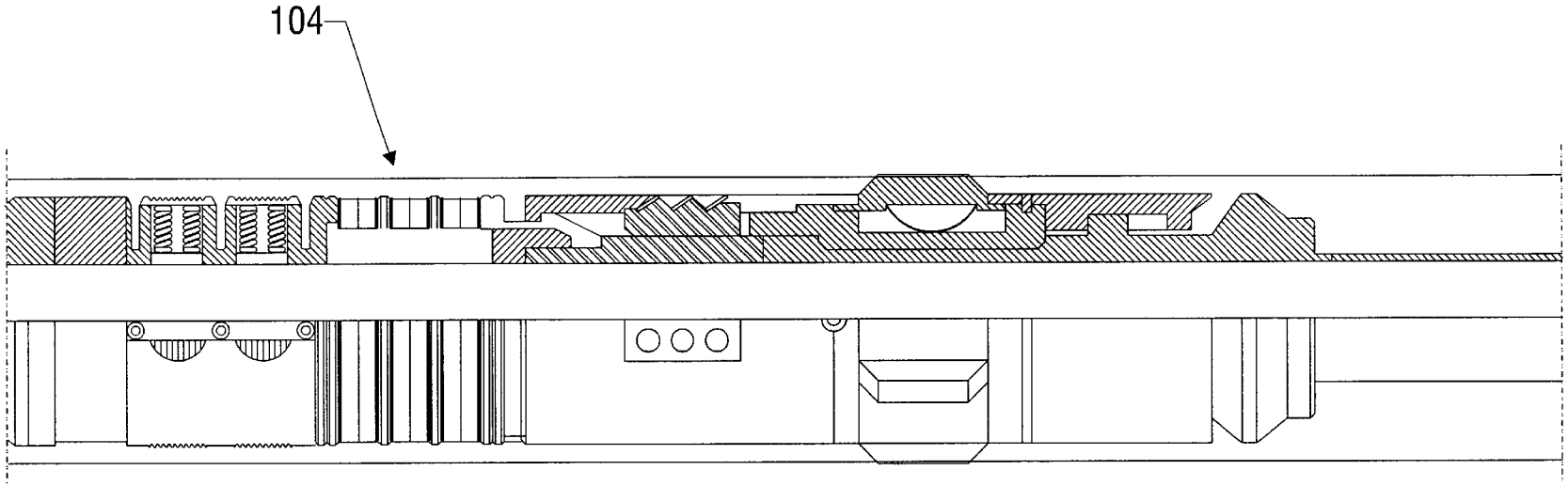
Figure 1J:
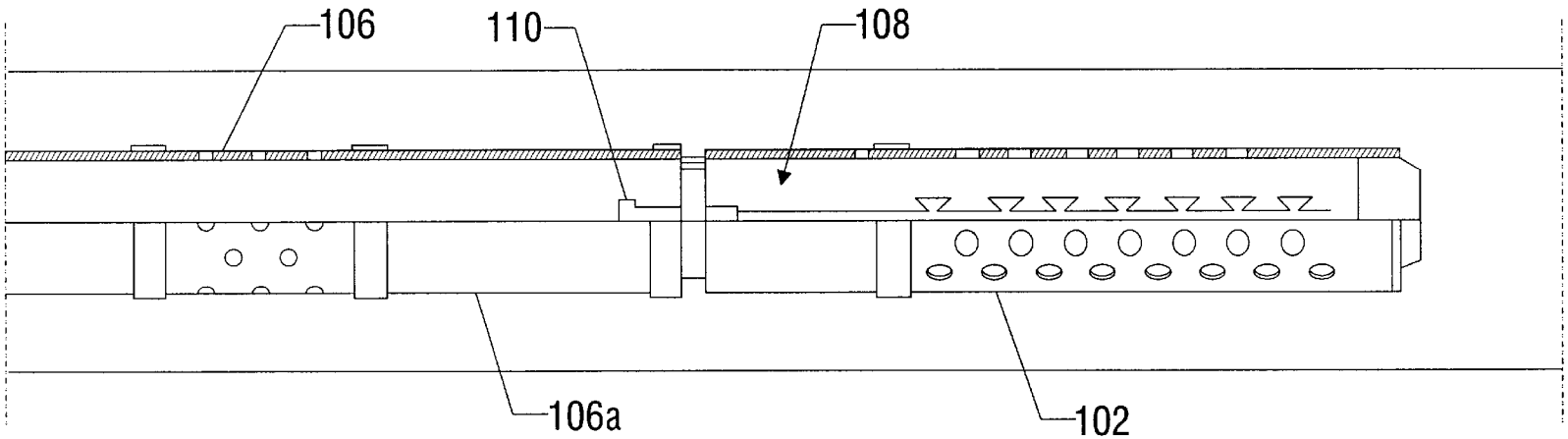

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers'specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Turning now to the drawings, and in particular to FIG. 1A–1J, a preferred embodiment of the single trip perforating and gravel pack system (100) is illustrated in accordance with the present invention. The single trip perforating and gravel packing system (100) includes a tubing conveyed perforating assembly, a gravel pack completion assembly, and a retrievable service assembly. The system is adapted to be attached to and run into the wellbore on a workstring composed of tubing or drillpipe.

The gravel pack completion assembly includes a hydraulically set gravel pack packer (112), such as a model GPS-1 or GPS-2 packer from BJ Services Company. It will be understood that other commercially available hydraulically set gravel pack packers may be used with the invention, such as the Arrow Pack. Sliding sleeve assembly (78) is connected to and extends beneath the gravel pack packer. The sliding sleeve assembly includes a plurality of flow ports (80) and a sliding sleeve (82). Sliding sleeve (82) is shiftable between a closed position and an open position whereby flow ports (80) are opened. Although shown in the open position in FIG. 1D, sliding sleeve 82 will normally be in the closed position when the system is in the running position. Sliding sleeve (82) includes upper and lower seals for sealing above and below flow ports (80) when the sleeve is in the closed position.

A polished bore receptacle (PBR) (84) is connected to the lower end of the sliding sleeve assembly (78). The polished bore receptacle (84) includes a seal bore for the seal units of the service assembly, thereby providing a sealing point beneath the sliding sleeve to force the gravel pack slurry through flow ports (80) and not past receptacle (84). Casing spacer (86) is connected to the lower end of receptacle (84). The casing spacer is connected to repeater collect assembly (88), which includes a collet with a plurality of collet fingers. The collet fingers may flex radially outward by an upward movement of the indicator shoulder **(53*a*) on the concentric check valve (53) so that movement of the indicator shoulder past the collet fingers will provide a surface indication of where the service assembly is relative to the completion assembly. By way of example, the upward movement of the service assembly may cause a 10,000 pound indication on the weight indicator at the surface when the indicator shoulder is pulled past the collet fingers on repeater collet assembly (88)**.

A lower casing spacer (89) is attached to the lower end of repeater collet assembly (88). Screen crossover sub (90) connects casing spacer (89) to pup joint (92). It will be understood that the length of the casing spacers (86 and 89) and pup joint (92) may be adjusted for proper spacing of the gravel pack completion assembly. Pup joint (92) is connected to gravel pack screen (94) which will be of sufficient length to extend across the interval of the wellbore to be perforated. The gravel pack screen (94) may be a standard wire wrap screen. Preferably, gravel pack screen (94) is a conventional prepacked wire wrap screen with epoxy coated gravel deposed in the annular space between the screen mesh and the outer diameter of base pipe (96). The grain and wire size and spacing of the gravel pack is determined by the granule size of the sand in the formation adjacent the perforations. Suitable gravel pack screens are available from manufacturers such as Houston Screen or Johnson Screens.

Connected to the bottom of the gravel pack screen (94) is a lower PBR (98) which provides an internal seal bore for the service assembly. When the lower seal assemblies on the service assembly are position in the lower PBR (98), gravel pack fluids can not pass through the screens and enter the bore of the service assembly. Instead, all fluids are forced through the internal diameter of the tool. With the sliding sleeve closed and the seals in the lower PBR, pressure is allowed to communicate down the workstring to the firing head for hydraulically firing the perforating guns.

Packer (104), which can be a service or squeeze packer, is attached to lower PBR (98). This packer serves two functions. First, it is used as a perforating packer when performing the perforating operation. Second, it is used as a sump, or lower, packer after the gravel pack screens are repositioned adjacent to the perforated formation. The lower end of the packer (104) then connects to the top of the perforating assembly. The service packer may be a rotational-set down J-Type packer such as the BJ TST2, SD-1, MR1220, or Arrow CST. Other commercially available packers may be used with this invention as well. The tubing conveyed perforating assembly may take various forms depending on the type of hook-up used. In one embodiment, the assembly comprises a tubing conveyed gun (102), a circulating sub (106), and a firing head (108), either with a bar actuated firing pin (110) or a hydraulic initiator or a combination of both. It should be understood that many types of firing heads may be used with the present invention. Circulating sub (106) extends from the service packer (104) and is connected on its lower end to spacer **(106*a*) which connects to firing head (108). Circulating sub (106) includes any number of flow ports spaced about the circumference of the tool for allowing fluid to flow into the service assembly before and after the perforation of the wellbore. The circulating sub also allows an operator to circulate down the workstring through the service assembly and out the sub above the perforating guns prior to setting the service packer (104)**.

Conventional tubing conveyed perforating guns are attached to the firing head. In a preferred embodiment, the perforating guns are detonated by a detonation bar which is dropped from the surface and lands on bar actuated firing pin (110). Alternatively, the system may be adapted to utilize other commercially available firing heads, such as a tubing pressure hydraulically actuated firing head, an annulus actuated firing head, or a wireline actuated firing head. In another embodiment, the system may include dual firing heads, such as a bar actuated firing head and a tubing pressure hydraulically actuated firing head. The redundant firing heads are used to ensure detonation in case one firing head fails. Preferably, the system includes a full bore internal passageway extending therethrough for providing access to the bar actuated firing head. The system preferably may also be hydraulically isolated prior to firing the perforating guns so that an internal pressure actuated firing head may be used. Hydraulic isolation is accomplished with sliding sleeve (82) in the closed positioned.

The single trip perforating and gravel pack system includes a retrievable service assembly which is releasably connected to the gravel pack packer (112). Once the gravel pack packer has been set and the service assembly has been released from the packer, the service assembly is adapted to be reciprocated longitudinally within the gravel pack completion assembly to maneuver the service assembly between its various operating positions, as will be discussed below.

The retrievable service assembly is illustrated in greater detail in FIGS. 2A–2F. The service assembly includes, among other items, a hydraulic setting tool and a crossover tool assembly. Beginning at the top of the hydraulic setting tool, an internally threaded top sub (1) is provided for connecting the system to a workstring, such as a drillpipe or tubing string. In addition, the top sub provides an internal seal bore for receiving the pump down shifting tool, described below. The top sub is threadedly attached to the top end of an upper body (2). The position of the top sub (1) relative to the upper body (2) is secured by a plurality of set screws (16). A plurality of o-rings (4) seal the gap between the adjacent surfaces of the top sub (1) and the upper body (2). A cylinder or outer housing (3) attaches about the outside diameter of the upper body (2) by a threaded connection and is secured in relative position with the upper body by a plurality of set screws (68). Enclosed within outer housing (3) is setting piston (15) and a preset mechanical locking arrangement for preventing the premature setting of the gravel pack packer from the shock waves generated by the detonation of the perforating guns. The preset lock assembly may comprise, among other items, lock sleeve (6), lock keys (7), retainer (8), locking collet (9), returnlock key (65), and spring (10).

Deposed within a circumferential groove about the outer diameter of upper body (2) is an o-ring seal (69) that prevents fluid passage through the adjacent surfaces of the cylinder (3) and upper body (2). The internal surface of the upper body includes a recess which houses lock sleeve (6). The lock sleeve, which is adapted for slidable movement along the internal diameter of the upper body, may be installed prior to connecting the top sub to the upper body. Lock sleeve (6) includes a recess **(6*a*) on its external diameter and a landing profile (6*b*) on its internal diameter. The landing profile is adapted to receive spring loaded keys with a mating profile on the pump down shifting tool, as described below. The lock sleeve (6), shown in the running position in FIGS. 1 and 2, is initially held in position by a plurality of shear screws (58). A plurality of radially inwardly biased piston lock keys (7) are adjacent the outer diameter of the lock sleeve (6). With the lock sleeve in the running position, as shown in FIGS. 1 and 2, the lock keys are maintained in their locked position by the outer diameter of sleeve (6). In the locked position, the lock keys (7) engage a lock profile on the inner diameter of retainer (8) that mechanically locks the setting piston (15), thereby preventing the setting of gravel pack packer (112)**.

Deposed about the outer diameter of upper body (2), beyond lock keys (7) is locking collet (9). As shown in FIG. 2, locking collet (9) is positioned between the upper body and the upper end of setting piston (15). Return lock key (65), disposed between retainer (8) and the upper end of piston (15), is biased radially inwardly by a compression spring (10). In the running position, locking collet (9) is located under return lock key (65) thereby compressing spring (10) and maintaining return lock key (65) in the unlocked position. Locking collet (9) is releasably connected to setting piston (15) by a plurality of shear screws (71).

The lower end of upper body (2) is threadedly connected to inner mandrel (27). An o-ring (5) provides a trash seal for the connection between the upper body (2) and the mandrel (27). Adjacent the inner mandrel (27) in a radially outward direction is the packer setting piston (15) with o-ring seals (13 & 14) deposed in annular grooves about the circumference of the head of the piston. These o-rings seal the annular areas between the piston (15) and the housing (3) and between the piston and the mandrel (27), respectively. Upward movement of the piston is limited by a piston stop (12). Piston extension (17) is threadedly connected to the lower end of piston (15). A set screw (59) secures the piston (15) to piston extension (17) while another set screw (73) concurrently affixes the piston extension (17) to piston setting sleeve (19).

A connector (20), positioned radially between the inner mandrel (27) and the piston extension (17), is secured in place relative to the piston extension (17) by a plurality of shear screws (74). A ring stop (66) protects the collet (29) from overload if the need arises, shear screw (18) shearing only if needed. Threadedly fastened about the external diameter of the connector (20) is a release mandrel (25) which is set in position relative to the connector by a plurality of set screws (21). Between the release mandrel (25) and the mandrel (27) is a key ring (22) and a plurality of mandrel keys (23). The key ring (22) holds the mandrel keys (23) in place.

Figure 9:
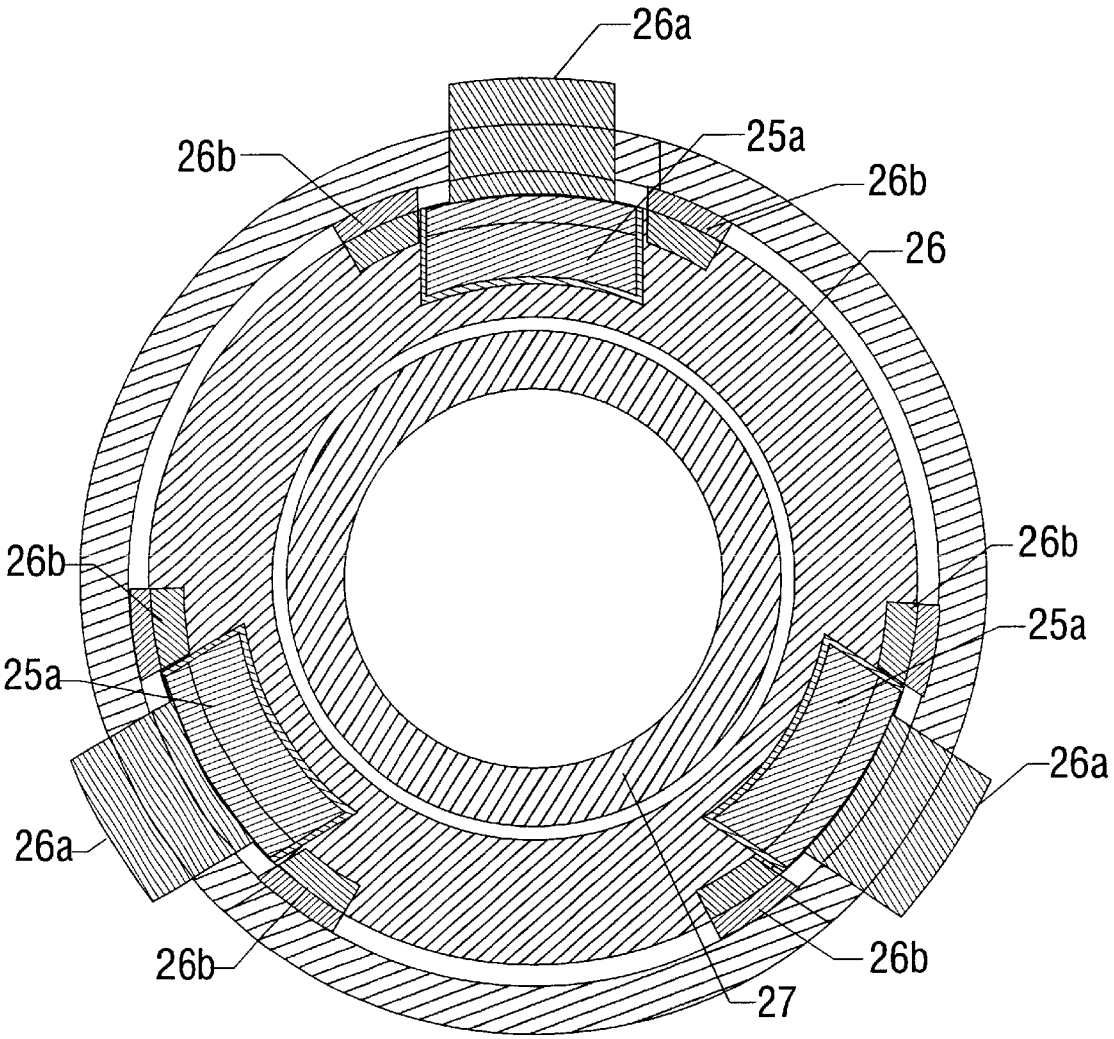
FIG. 9 is a vertical cross sectional view of the service assembly taken at section A—A of FIG. 2B.

The setting tool includes a mechanically actuated rotational lock which may comprise, among other items, collet sleeve (24), release collet (26), release mandrel (25) and inner mandrel (27). Collet sleeve (24) and release collet (26) are attached by set screws (11) about the release mandrel (25). Release collet (26) includes a plurality of longitudinally extending fingers spaced equally about the circumference of the collet with enlarged support members (26*a*) on their ends. In a preferred embodiment, release collet (26) has three arms spaced 120 degrees apart. The upper end of the release collet (26) also includes a plurality of radially inwardly extending lugs (26*b*), which are adapted to engage slots (25*b*) on release mandrel (25). Release mandrel (25) has the same number of arms as release collet (26) has fingers. In a preferred embodiment, release mandrel (25) has three arms spaced 120 degrees apart and each arm extends beneath one of the fingers on release collet 26. The arms on release mandrel (25) include radially extending shoulders (25*a*) that support the enlarged support members (26*a*) as shown on FIG. 9, thereby allowing members (26*a*) to engage the internal profile on the inner diameter of the packer setting sleeve (112*f*). Lugs (26*b*) on release collet (26) interlock with slots (25*b*) in release mandrel (25) in order to rotationally lock release collet (26) to release mandrel (25). Keys (23) rotationally lock inner mandrel (27) to release mandrel (25). Slots (26*c*) on the lower end of release collet (26) engage with packer (112) at lugs (112*a*) to rotationally lock the packer to the hydraulic setting tool.

Downward movement of release mandrel (25) relative to release collet (26) causes slots (25*b*) to disengage with lugs (26*b*) to unlock the rotational lock. The rotational lock allows an operator to transmit torque to the entire system when the system is in the running position. This allows, for instance, the ability to rotate the entire system through a tight spot in the well when running in the hole. This is particularly useful when running the system into a horizontal wellbore.

On the lower portion of the hydraulic setting tool is collet mandrel (28) and a locking mandrel (29). Collet mandrel (28) has a plurality of longitudinally extending arm segments (28*a*) extending about its circumference for engaging with packer threads (112*b*). Adjacent the locking mandrel (29) are locking keys (30), which extend between the arms of collet mandrel (28). Locking keys (30) rotationally lock collet mandrel (28) and locking mandrel (29) to inner mandrel (27). A plurality of lower lock segments (31) are located in recesses in the outer diameter of inner mandrel (27). Preferably, there are three lock segments spaced 120 degrees apart. The lock segments are biased radially outward by biased springs (32). In the running position, the lower lock segments are maintained in their unlocked position by the lower end of locking mandrel (29). Shear screws (70) secure locking mandrel (29) to inner mandrel (27). Locking mandrel (29) and collet mandrel (28) form the annulus release means for releasing the service assembly from the completion assembly.

Figure 5A:
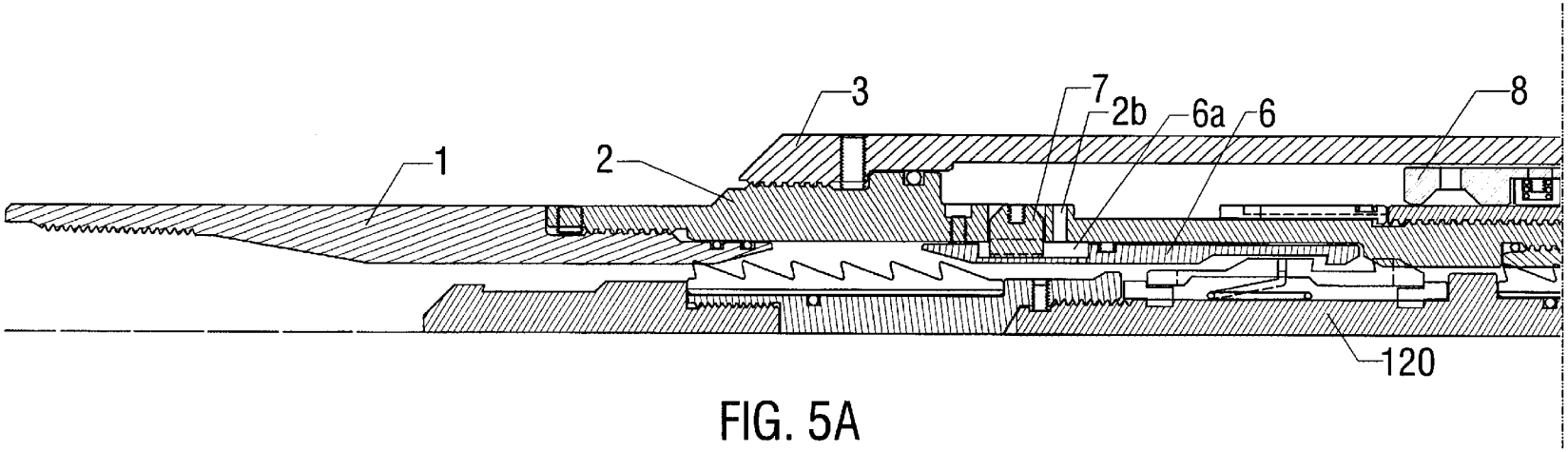
FIGS. 5A–5C are cross-sectional views of a preferred embodiment of the service assembly in the packer setting position.
Figure 5B:
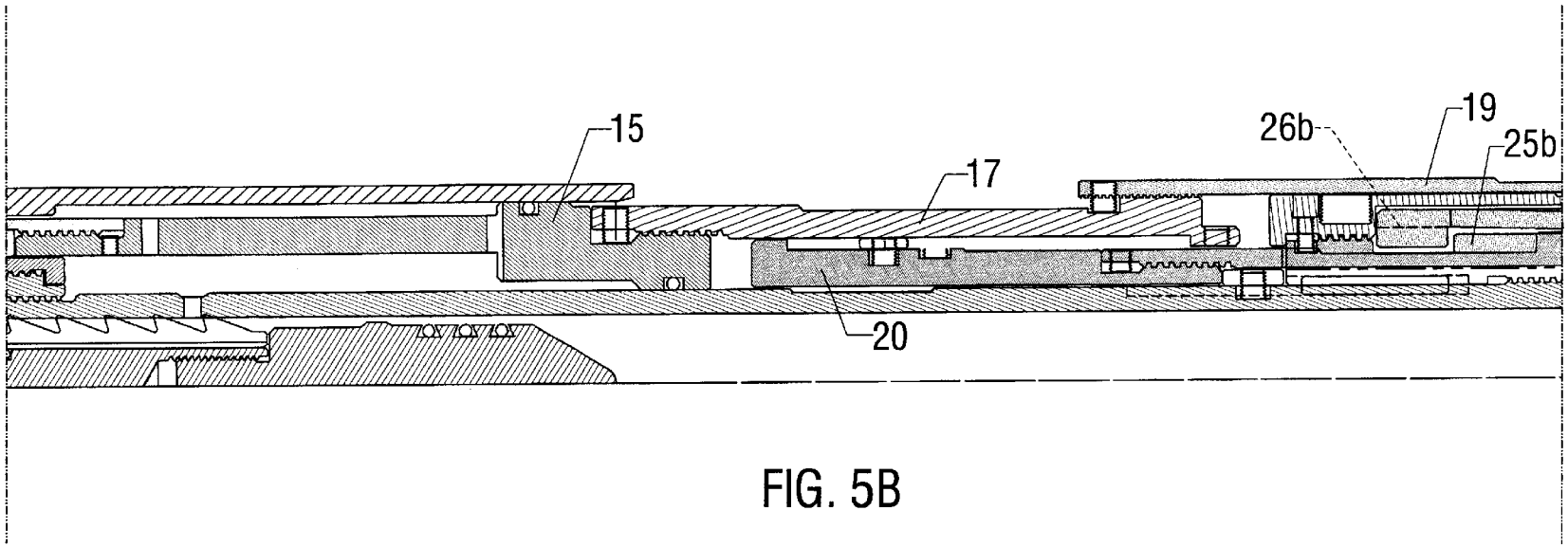
Figure 10:
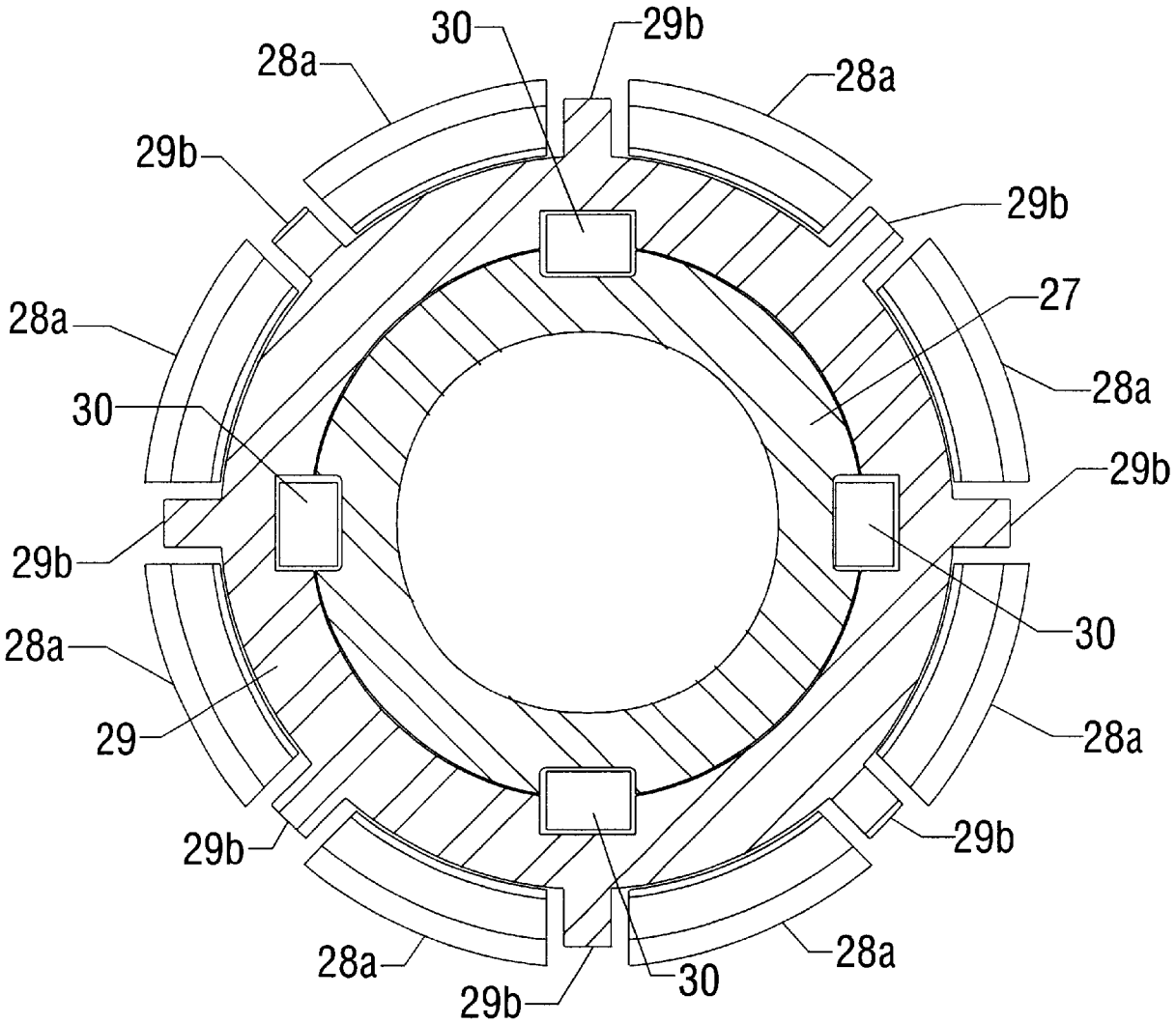
FIG. 10 is a vertical cross sectional view of the service assembly taken at section B—B of FIG. 2B.

In operation, locking mandrel (29) supports the collet arms (28*a*) of collet mandrel (28) (shown in FIG. 10) to keep arms (28*a*) engaged in packer threads (112*b*). When setting packer (112), the piston (15) strokes downward causing release mandrel (25) and release mandrel shoulder (25*e*) to move downward. Release mandrel shoulder (25*e*) engages locking mandrel collet (29) at shoulder (29*a*) and permanently locks them together as shown in FIGS. 5B and C. The annulus release will then release arm segments (28*a*) from packer (112) when annulus pressure working on piston (15) causes the piston to move upward. The upward movement of piston (15) causes locking mandrel (29) to shear screws (70) and pull locking mandrel (29) out from under arm segments (28*a*) thereby allowing the arm segments to collapse and release from the packer. Lock segments (31) are then expanded by springs (32) to prevent locking mandrel (29) from moving back under collet arms (28*a*).

Operation of the lower packer pre-set lock is also controlled by release mandrel (25). When release mandrel shoulders (25*a*) are under enlarged support members (26*a*), support members (26*a*) engage in the packer setting profile (112*e*) and lock the packer to prevent presetting. When release mandrel (25) strokes downward, shoulders (25*a*) move out from under member (26*a*), allowing member (26*a*) to collapse and the packer to be set.

The lowermost end of the hydraulic setting tool includes seal adapter (33), which is threadedly attached about the lower end of mandrel (27). The connection between the seal adapter and the mandrel is sealed by a plurality of o-rings (72). Molded seals (36) are located about the outer diameter of the seal adapter (33) for sealing against the seal bore of gravel pack packer (112).

The hydraulic setting tool is connected to the crossover tool assembly. The crossover tool assembly comprises, among other components, the upper crossover mandrel (38), upper and lower seal units, ported crossover sub (42), concentric check valve (53), indicator (52), sliding sleeve shifting tool (56), bypass tube (37), landing nipple (45), shifting tool stop (46), top washpipe (60) and bottom washpipe (75). Bypass tube (37) extends from the lower portion of seal adapter (33). O-ring seals (34) are located in annular grooves on the inside diameter of seal adapter (33) and seal the connection between bypass tube (37) and seal adapter (33). Upper crossover mandrel (38) extends from the lower end of seal adapter (33), with o-ring seal (35) sealing the overlapping surfaces of the mandrel and adapter. O-ring seals (35) are also provided to seal the connections between the remaining components of the crossover tool assembly. The crossover mandrel (38) includes a plurality of radially extending flow ports (38*a*). Extending from the lower end of the crossover mandrel (38) is a plurality of seal sub extensions (39). Each seal sub extension includes a molded seal assembly (36) positioned about its outer diameter which, when properly positioned, will seal against the seal bore of the gravel pack packer and PBR (84). An o-ring seal (35) provides a seal between the molded seal and the seal sub extension. The plurality of seal sub extensions above the gravel flow ports (42*a*), along with their respective molded seal assembly, comprise the upper seal units. The number of seal sub extensions may vary depending on the spacing required to manipulate the service assembly during gravel packing operations.

Attached to the bottom of the lowermost seal sub extension (39) is crossover sub adapter (67), which is threadedly attached on its lower end to crossover sub (42). Spacer (40) may be inserted between crossover sub (42) and bypass tube (37) to create a smooth flow path between the components. O-ring seals (41) seal the annular area between bypass tube (37) and crossover sub (42). Crossover sub (42) includes a plurality of radially extending gravel flow ports (42*a*). Crossover sub (42) also includes a plurality of longitudinally extending flow passages (42*b*) which are spaced circumferentially between flow ports (42*a*). Return flow passages (42*b*) are in communication with the annular flow passageways extending between the bypass tube (37) and the upper seal units and the crossover mandrel as well as between the lower seal units and the shifting tool connector and top and bottom washpipe. Attached to the lower end of the crossover sub (42) is the lower seal units comprising a plurality of seal subs (44). In a preferred embodiment, a shifting tool landing profile (45) is threadedly connected to the innermost set of internal threads on the crossover sub. O-rings (35 & 55) seal the connections between the seal subs and crossover sub. A set of molded seals (36) is attached to the outer diameter of each seal sub. The length of the lower seal units may vary depending on the spacing required to manipulate the service assembly during gravel packing or frac packing operations.

The shifting tool landing profile (45) includes an internal landing profile (45*a*) for receiving a pumpdown shifting tool, described below. The shifting tool connector is threadedly connected to a shifting tool stop (46), and the shifting tool stop is connected to a top washpipe (60). The shifting tool stop (46) provides a bore in which the nose seal on the pumpdown shifting tool will seal. The top washpipe (60) extends to washpipe collar (61), which connects the top washpipe (60) with bottom washpipe (75). The threaded connections between the washpipe collar (61) and the top and bottom washpipe are both sealed by o-rings (47). The connection between the shifting tool connector (45) and the shifting tool stop (46) is sealed by o-ring (48).

The lowermost seal sub (44) is connected to an indicator extension (49). The connection between the seal sub (44) and the indicator extension (49) is sealed by a plurality of o-rings (35), and a molded seal (36) is deposed about the outer diameter of the indicator extension. The indicator extension (49) is adjacent to an indicator connector (50), and the indicator connector is attached to the indicator (52). Indicator (52) will provide a surface indication when the indicator is pulled past the collet on repeater collet (88), as described above. The connection between indicator connector (50) and indicator (52) is sealed by o-ring (43).

Figure 2A:
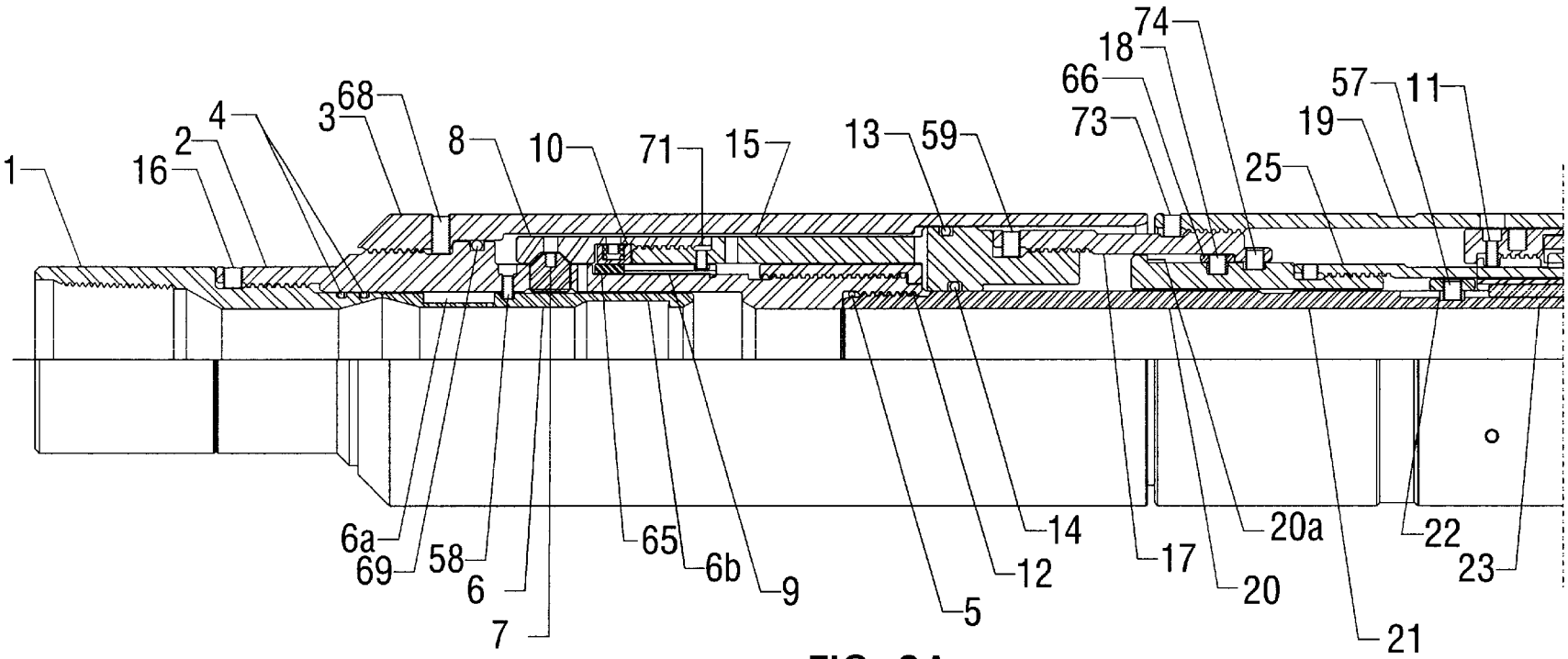
FIGS. 2A–2F are cross-sectional views of a preferred embodiment of the service assembly for the perforating and gravel pack system in the running position.
Figure 2B:
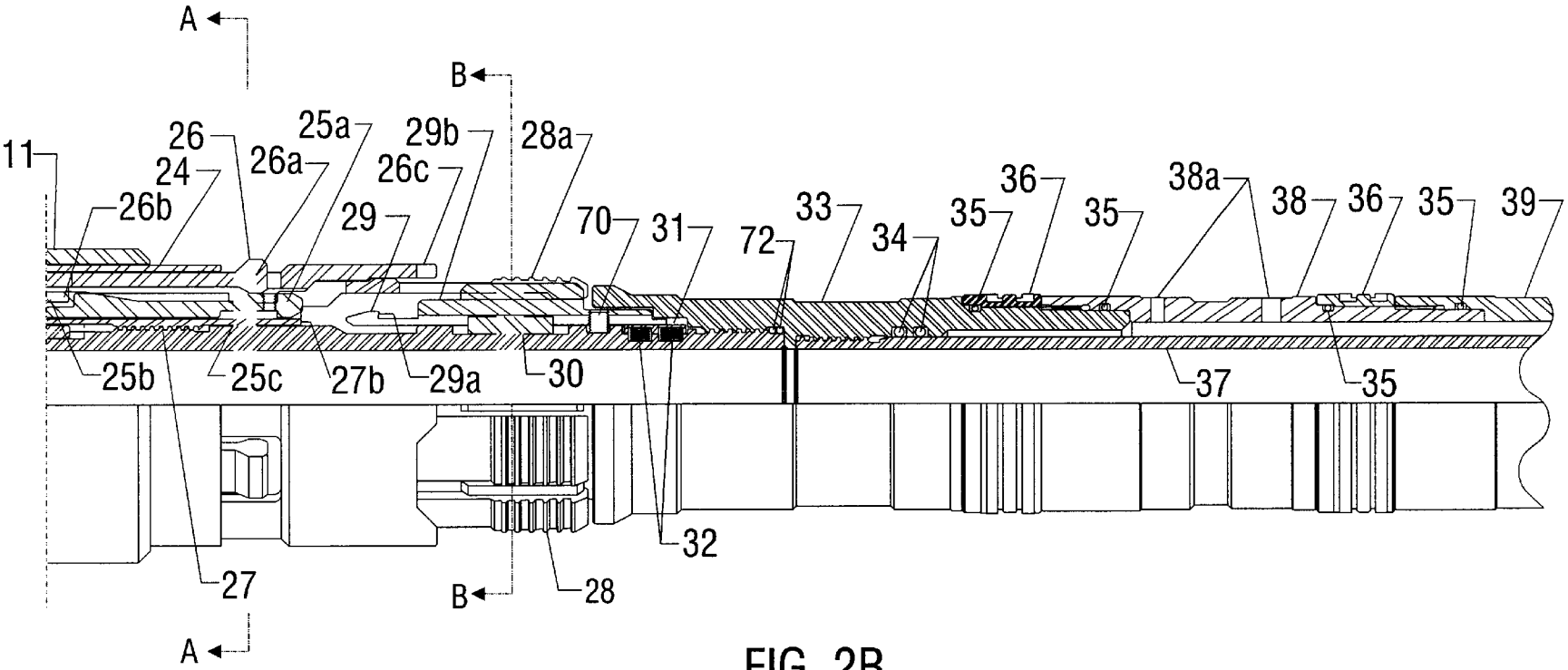
Figure 2C:
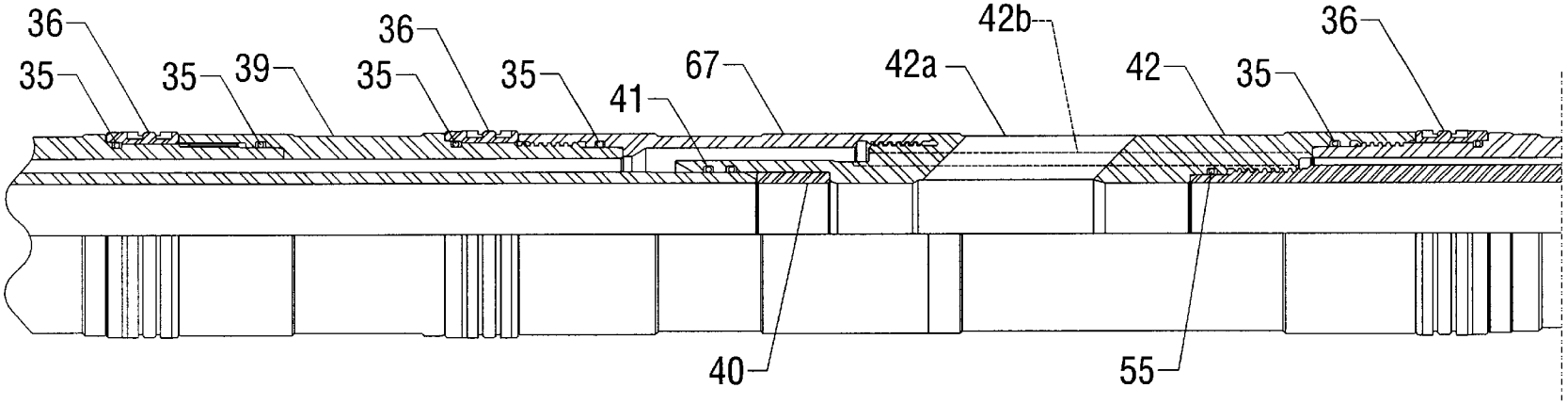
Figure 2D:
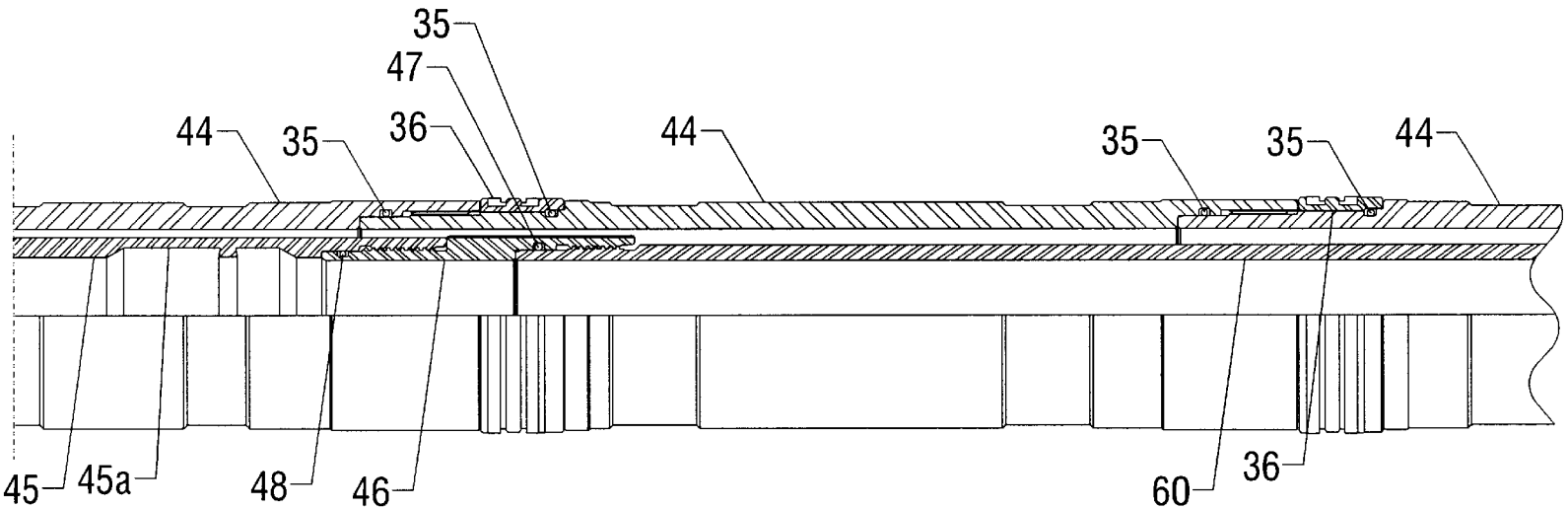
Figure 2E:
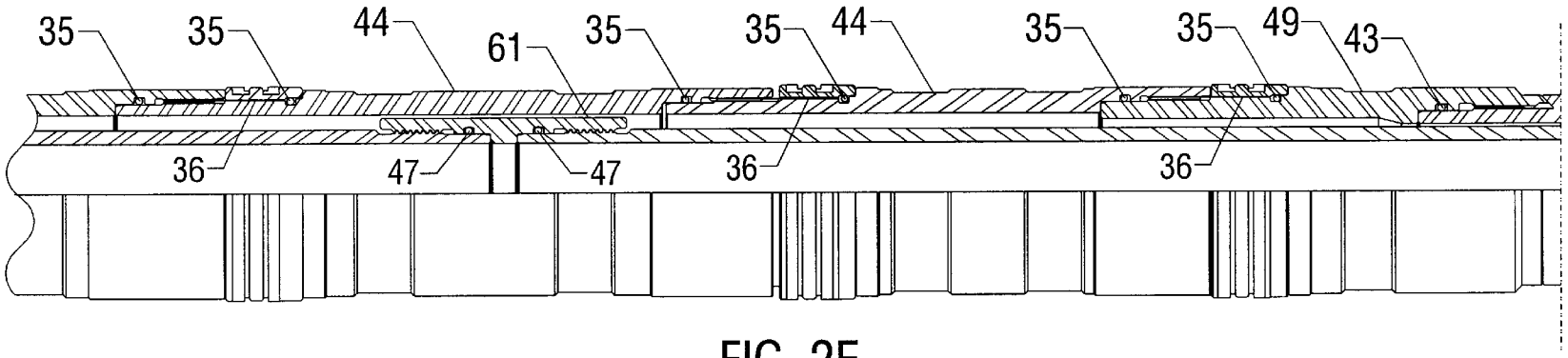
Figure 2F:
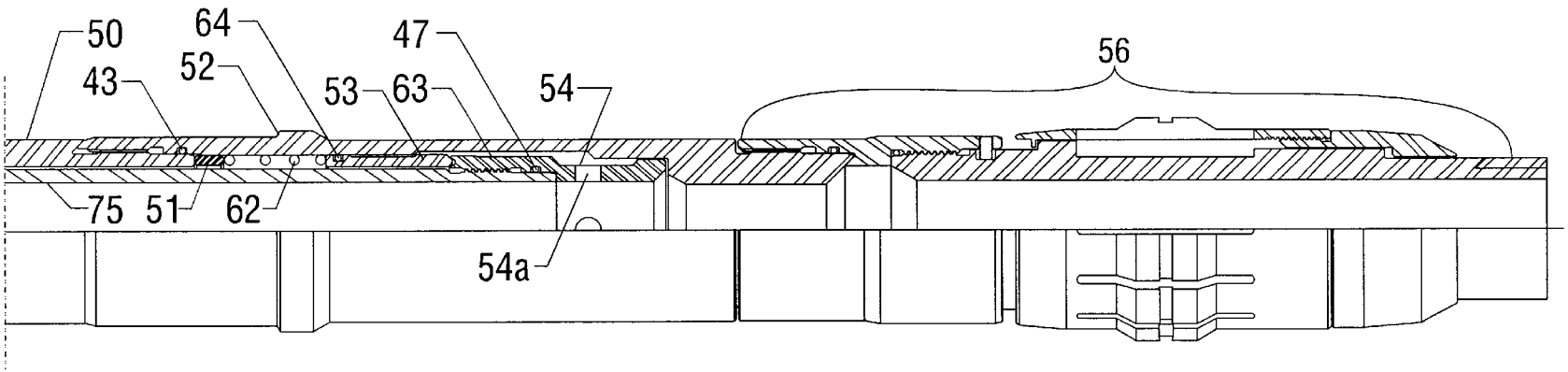
Figure 3:
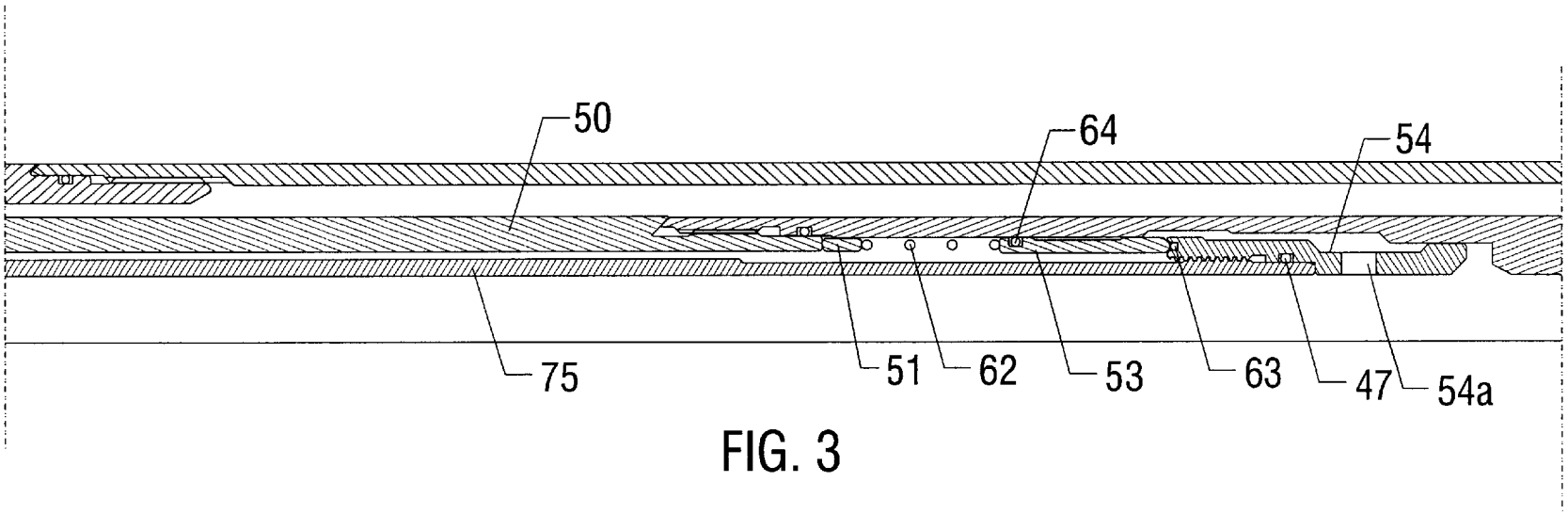
FIG. 3 is a cross-sectional view of the concentric check valve in the service assembly.

As illustrated in FIGS. 2F and 3, a concentric, donut-shaped check valve is located in the annular space between indicator (52) and bottom washpipe (75). The check valve comprises spring ring (51), valve spring (62), piston (53) and valve retainer (54). O-ring seal (64) is located in an annular groove in the outer diameter of piston (53) and provides a seal between the outer diameter of piston (53) and the inner diameter of indicator (52). The top of valve retainer (54) includes an annular recess for retaining seal (63) which provides a seal between the top of valve retainer (54) and the lower end of piston (53). O-ring (47) is located in an annular groove on the interior surface of valve retainer (54) and seals the connection between the valve retainer and bottom washpipe (75). Valve retainer (54) includes a plurality of flow ports (54*a*) for passage of return fluid flow from the gravel pack operations. Spring (62) biases piston (53) in the closed position as shown in FIGS. 2 and 3. Once piston (53) has moved out of engagement with seal (63), fluid flow is permitted between the inner diameter surface of piston (53) and the outer diameter of bottom washpipe (75). During gravel pack operations, return fluid flow will enter flow ports (54*a*) and overcome the spring force exerted by spring (62), thereby opening the concentric check valve so return fluid flow can flow through the check valve and up the flow passageway through the crossover tool assembly. Once the gravel pack or frac pack operations are completed, spring (62) moves piston (53) to the closed position, thus preventing reverse fluid flow through the annular space in the crossover tool assembly.

Sliding sleeve shifting tool (56) is connected to the bottom of indicator (52). The sliding sleeve shifting tool includes a collet device which is adapted to engage and shift sliding sleeve (82) from the closed position to the open position, or vice versa. The shifting tool is attached at its lower end to the conventional washpipe (75). Seal assemblies (116) are attached to the bottom of the washpipe and are adapted to seal in the lower polished bore receptacle (98). A plurality of seals, such as chevron or bonded seals, are carried by the seal assemblies. A mule shoe may be attached to the bottom of the seal assemblies for facilitating the stabbing of the surface assembly inside the completion assembly.

The single trip perforate and gravel pack system is run into the hole after being assembled at the surface. The entire assembly is run into the wellbore on a workstring until the perforating guns are positioned adjacent to the producing zone to be perforated. The wellbore fluid may be conditioned by circulating it through circulating sub (106). The service packer (104) is set and tested. The well may be perforated in an underbalanced, overbalanced, or balanced condition. The tubing conveyed perforating guns (102) are detonated by using any of the options disclosed above. In the preferred embodiment, the guns are detonated by dropping a bar from the surface which lands on bar actuated firing pin (110). Alternatively, a hydraulically actuated firing head may be actuated by applying pressure to the workstring. Commercially available shock absorbers or automatic gun releases may be used in conjunction with the invention.

Following the perforation of the wellbore, the well may be flowed for cleanup or production tests may be conducted. If extensive testing is anticipated, a single acting or multiple acting ball valve and gauge carriers [not shown] may be run above the service packer for conducting drillstem testing operations. The ball valve is placed above the service packer and may be single or multiple acting. These ball valves can be actuated by application of annular or tubing pressure or a combination of both. The ball valve is normally used to underbalance the well or allow fluid circulation between the tubing and annulus to condition or circulate well fluids. Ball valves and gauge carriers are well known in the art.

Following the cleanup and/or testing operations, the service packer (104) is unset and the entire system is repositioned in the well so that the gravel pack screens are positioned adjacent to the perforations. Preferably, the gravel pack screens extend a short distance above and below the perforated interval. By way of example, the screens may extend about ten feet above and below the perforated interval. Service packer (104) is reset and thereafter functions as a sump packer below the gravel pack screens.

Figure 4A:
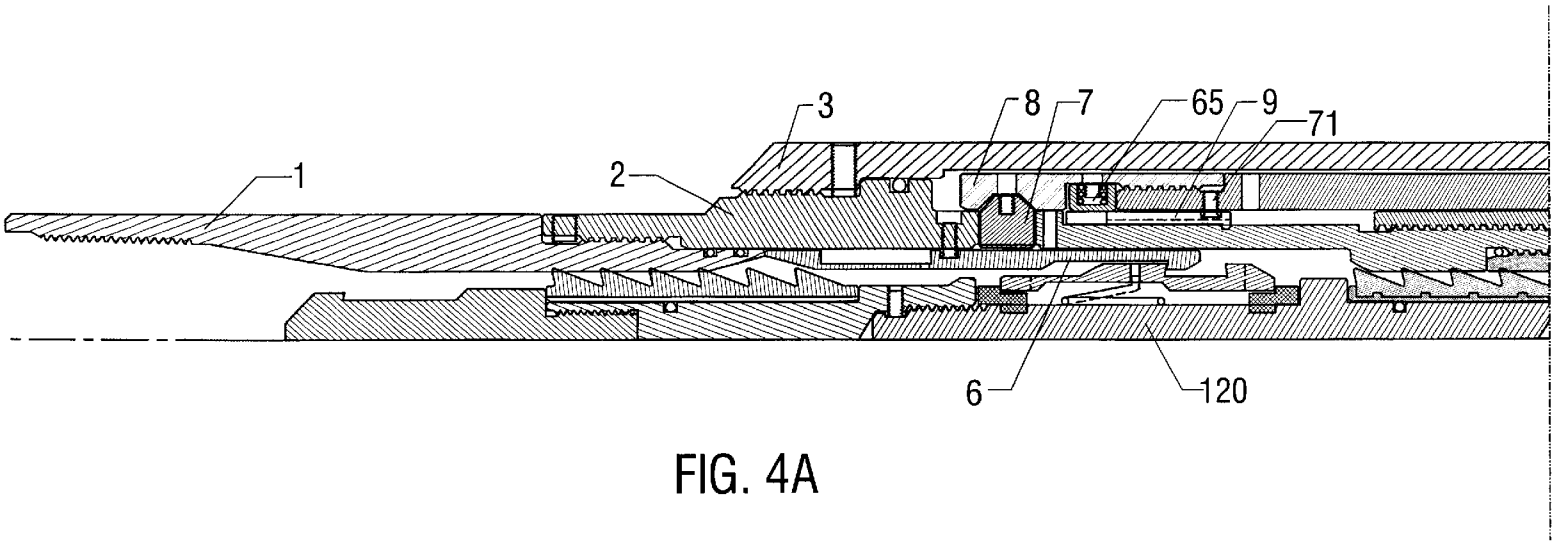
FIGS. 4A–4C are cross-sectional views of a preferred embodiment of the service assembly in the running position;.
Figure 4B:
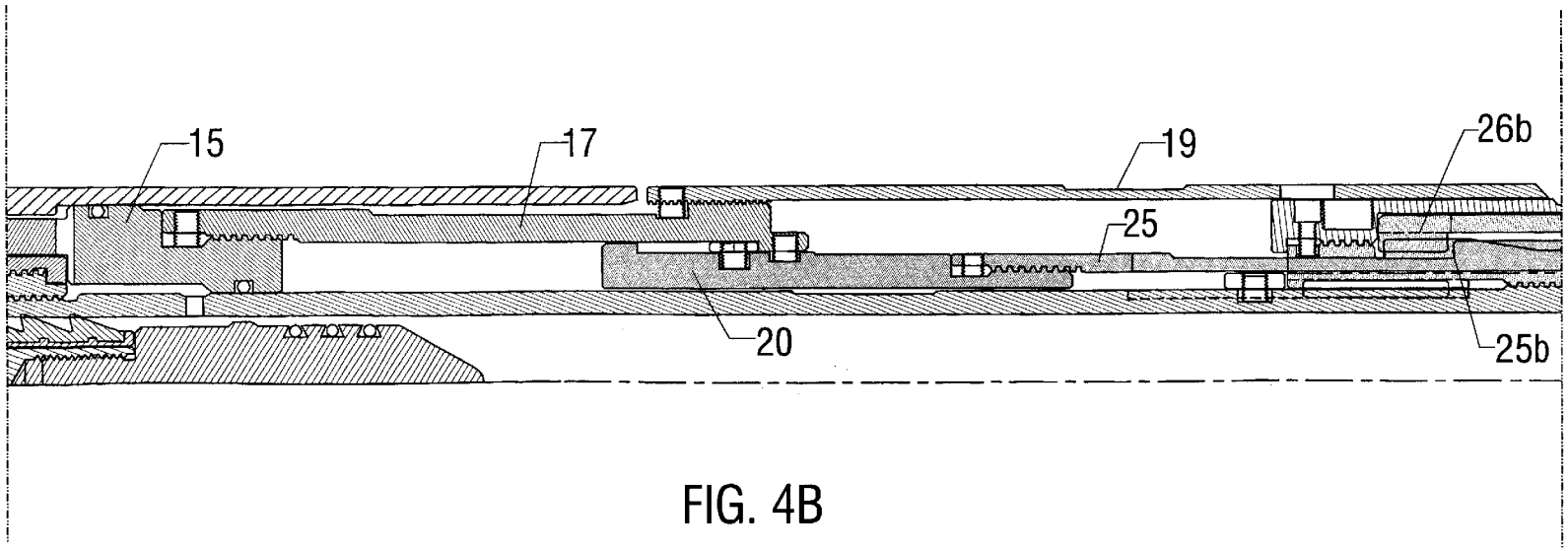
Figure 4C:
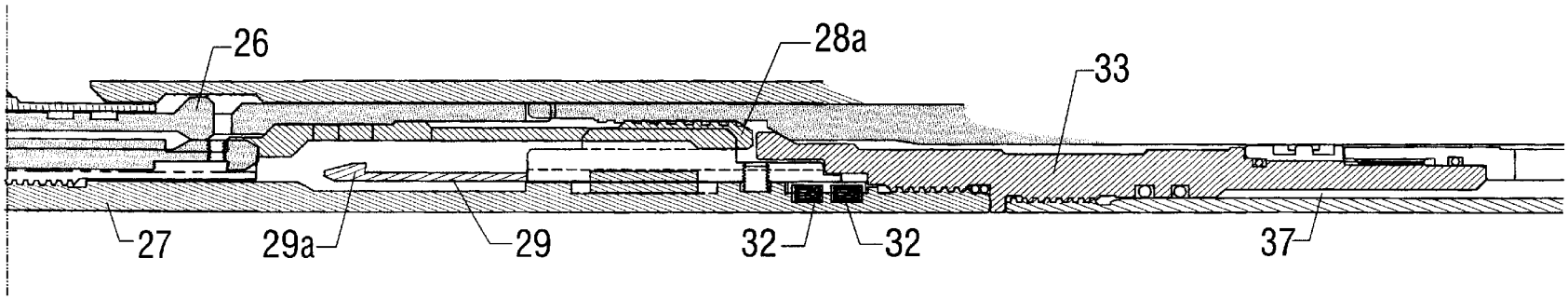
Figure 7:
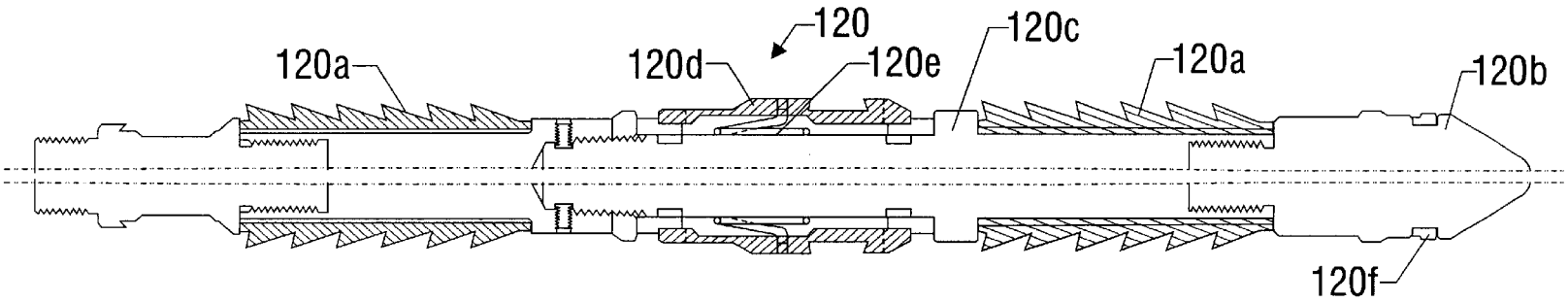
FIG. 7 is a cross-sectional view of a preferred embodiment of the pump down shifting tool.

Once the service packer has been reset, the gravel pack packer is set to isolate the well between the packers. To set the gravel pack packer, pump down shifting tool (120) is either pumped down, allowed to gravitate down the workstring, or run by wireline (cups 120*a* may be removed) and positioned into the hydraulic setting tool, as shown in FIGS. 4A–4B. The configuration of the pump down shifting tool allows it to be easily pumped to the hydraulic setting tool when the system is used in a horizontal wellbore. The pump down shifting tool, as shown in FIG. 7, comprises a nose plug (120*b*) attached to an inner mandrel (120*c*). The mandrel may be comprised of several components threaded together to facilitate manufacturing or assembly of the tool. Spaced radially about the center of the tool is a plurality of spring biased locking keys (120*d*). The locking keys are biased radially outwardly by the key springs (120*e*). Upper and lower elastomeric fins (120*a*) are positioned about the outer diameter of the inner mandrel of the shift down pumping tool. The upper and lower fins provide 360 degree wall contact with the inner sealing bores of the hydraulic setting tool. The spring loaded locking keys (120*d*) are positioned between the upper and lower fins and are designed to engage the mating profile (6*b*) on the inner diameter of the mechanical lock sleeve (6).

When the keys engage the profile on lock sleeve (6), the uppermost fins will be in sealing engagement with the internal seal bore of top sub (1). Pressure is applied to the workstring until the force acting on the pump down shifting tool will exceed the shear value of shear screws (58), after which lock sleeve (6) shifts to the unlocked position, as shown in FIGS. 5A–5B. The lowermost fins on the pump down shifting tool will engage the inner diameter of mandrel (27) as the lock sleeve (6) shifts to the unlocked position. The lock sleeve will move down relative to upper body (2) until the lower end of the lock sleeve reaches the lower internal, upwardly facing shoulder on upper body (2). In this position, recess (6*a*) is now positioned beneath piston lock keys (7). The internal pressure in the workstring will then communicate through ports (2*b*) in upper body (2) and apply a force on setting piston (15). The applied force to piston (15) will cause the piston lock keys to retract inwardly into recess (6*a*), thereby releasing setting piston (15) to stroke downward to set the gravel pack packer.

Figure 8A:
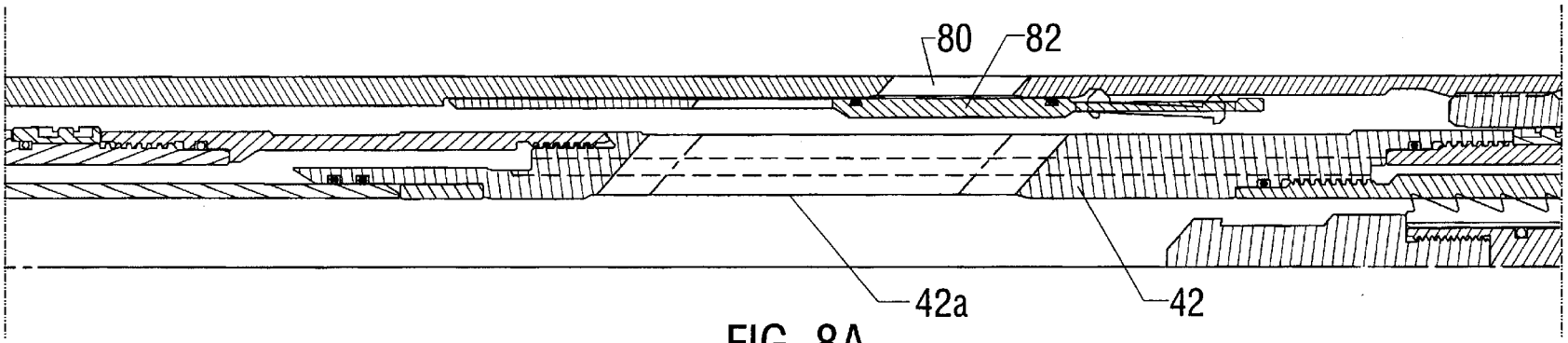
FIGS. 8A–8B are cross-sectional views of the pump down shifting tool landed in the landing nipple and the sliding sleeve in the closed position.
Figure 8B:
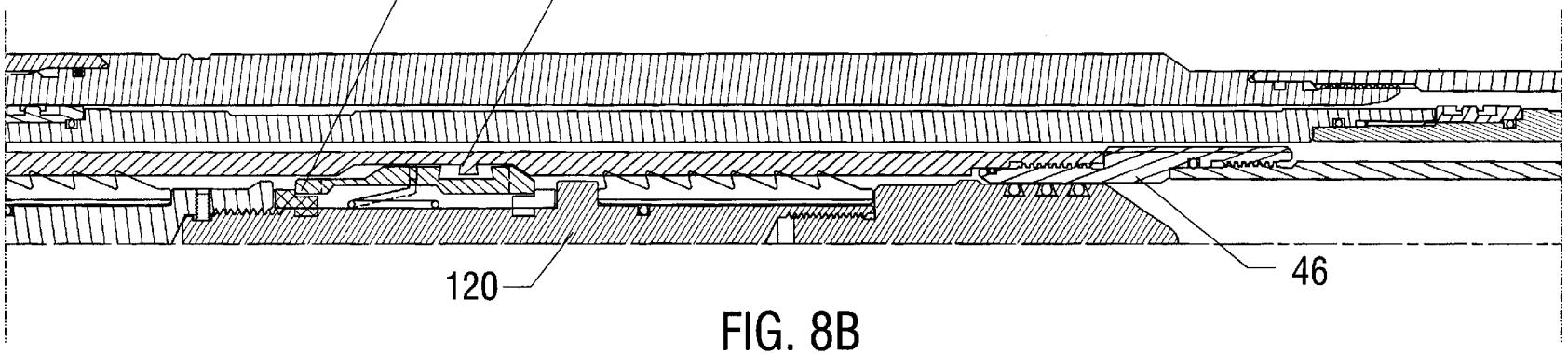

When lock sleeve (6) shifts to the unlocked position, the tapered inwardly facing release shoulder (2*a*) on upper body (2) contacts the leading tapered edge of the locking keys on the pump down shifting tool. The contact between the shoulder and the locking keys causes the locking keys to compress inwardly, thereby releasing from the profile on lock sleeve (6). Continued pumping moves the pump down shifting tool to the internal landing profile on shifting tool landing profile (45), as shown in FIGS. 8A–8B. The rubber fins are spaced so that the pump down shifting tool can be pumped past the gravel pack ports (42*a*). The locking keys on the pump down shifting tool will expand radially and engage the internal profile, thereby permanently locking the pump down shifting tool below frac ports (42*a*). An elastomeric seal (120*f*) is contained in an external annular groove on the nose of the pump down shifting tool. The nose seal on the pump down shifting tool will seal in the bore of the shifting tool stop (46), beneath the internal landing profile on shifting tool connector (45). Once the pump down shifting tool has locked into the profile, the passageway in the service assembly below the crossover ports is permanently closed and holds pressure from both directions. Alternatively, the pump down shifting tool may be modified so that it is retrievable.

Figure 5C:
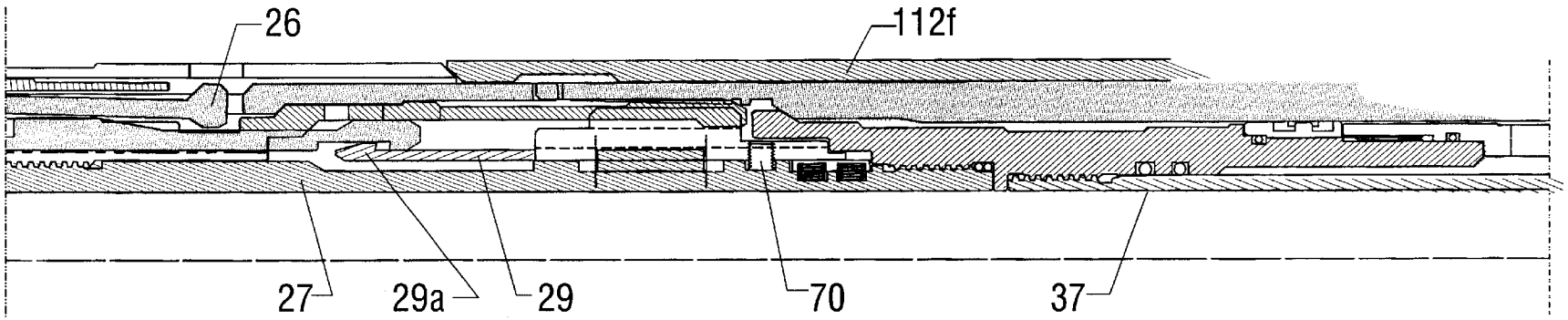

Additional pressure is applied to the workstring against the plug formed by the pumped down shifting tool to continue setting the gravel pack packer. The additional pressure acts on seals (13) and (14) of setting piston (15) causing the piston to stroke downwardly relative to the packer until setting sleeve (19) engages the packer setting sleeve (112*f*), as illustrated in FIGS. 5A–5C. The downward movement of piston (15) is also translated to release mandrel (25) via connector (20). Thus, piston (15), connector (20) and release mandrel (25) move together as a unit. As the release mandrel moves down, its support shoulder moves out from under the enlarged support members (26*a*) of release collet (26). This allows the fingers on the release collet to collapse inwardly, thereby releasing the support members (26*a*) from the internal recess on the packer setting sleeve (112*f*). The packer setting sleeve is now free to move. The downward movement of the release mandrel also causes the separation of the slots (25*b*) on the release mandrel with the lugs (26*b*) on the release collet to release the rotational lock, as shown in FIG. 5B. Once the rotational lock has been released, torque may no longer be transmitted through the tool to the service packer. Further downward movement of the setting piston will allow the inner profile on the lower end of release mandrel (25) to move over and engage the collet fingers on locking mandrel (29) as shown in FIG. 5C. Continued downward movement of the setting piston will compress the packer element and set the slips of the gravel pack packer in conventional fashion. Thus, once lock sleeve (6) has been shifted to the unlocked position, the downward movement of setting piston releases the rotational lock and lower preset lock, causes the engagement with the locking mandrel (29) of the annulus release mechanism, and sets the gravel pack packer.

Figure 6A:
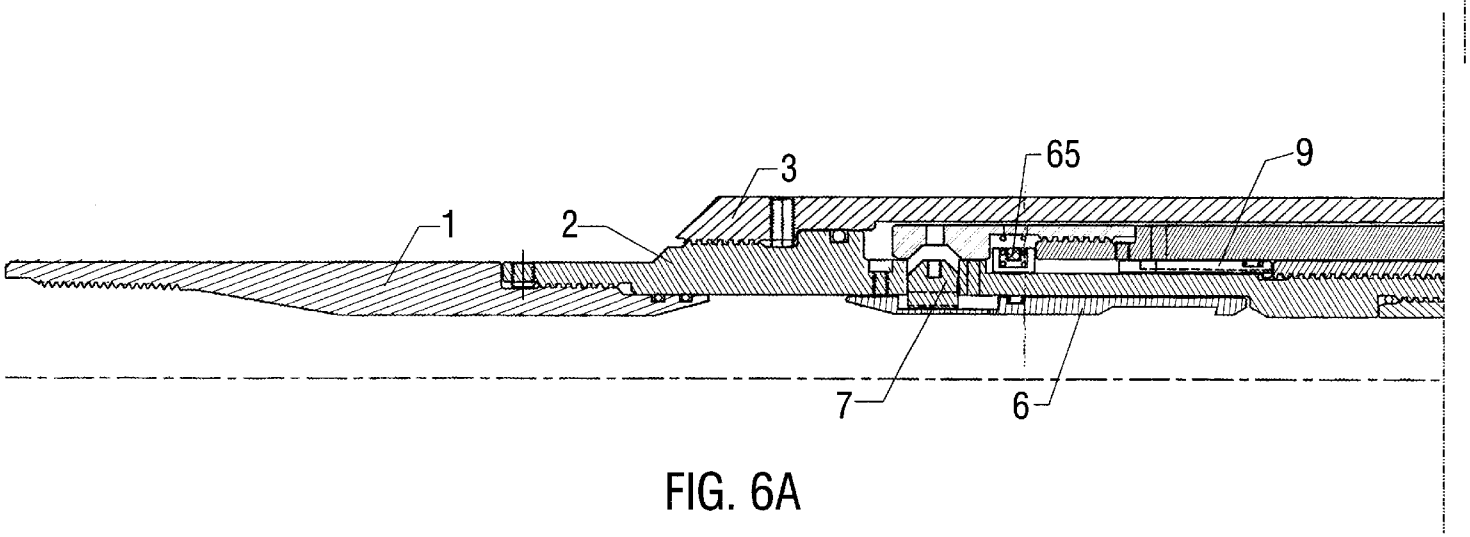
FIGS. 6A–6C are cross-sectional views of a preferred embodiment of the service assembly illustrating the actuation of the annulus release mechanism.
Figure 6B:
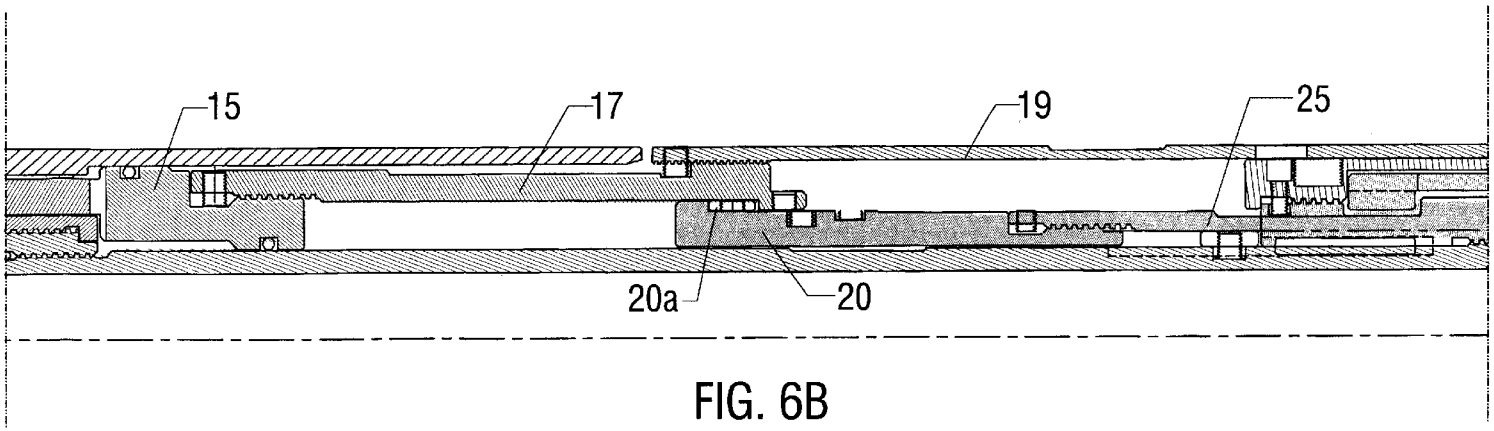
Figure 6C:
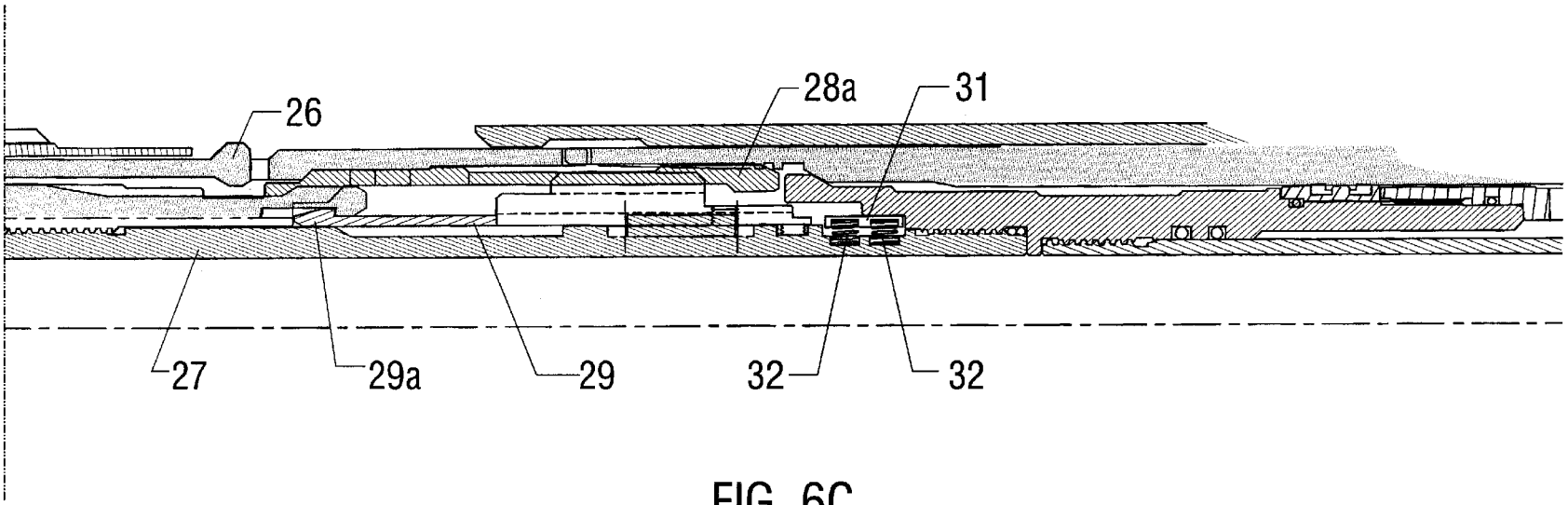

Once the gravel pack packer has set, the packer is tested on the back side (i.e., on the annulus above the packer element) to a specified pressure to ensure that the packer is properly set. Assuming a satisfactory test, additional annulus pressure is applied to activate the annulus release mechanism of the system to release the service assembly from the packer. More particularly, the annulus pressure is applied to o-ring seals (13) and (14) on setting piston (15) when the piston is in the down position. The annulus pressure creates an upward force acting on the bottom on the piston (15). As illustrated in FIGS. 6A–6C, the piston moves uphole until the inwardly extending shoulder on piston extension (17) engages shoulder (20*a*) of connector (20). Release mandrel (25) will in turn apply an upward force on locking mandrel (29) at (29*a*). When the annulus pressure reaches a predetermined value, the force exerted on the piston exceeds the value of shear screws (70). Once shear screws (70) have sheared, piston (15), along with connector (20), release mandrel (25) and locking mandrel (29), move further uphole. When locking mandrel (29) moves uphole, the support for the arm segments (28*a*) for collet mandrel (28) is removed, thereby allowing the arm segments (28*a*) of collet mandrel (28) to collapse. Once the arm segments (28*a*) have collapsed, the service assembly is released from the gravel pack packer and the remaining components of the gravel pack completion assembly and perforating guns assembly.

In a preferred embodiment, an emergency rotational release is possible by rotating collet arm segments (28*a*) to the right while locking keys (30) are engaged with inner mandrel (27). A plurality of lugs (29*b*), are positioned between collet arm segments (28*a*). In a preferred embodiment, six lugs are spaced 60° apart. If torque is applied through the workstring, torque is transmitted to the collet arm segments (28*a*) by lugs (29*b*) so the threads on arm segments (28*a*) may be rotated out of packer threads (112*b*).

The upward movement of locking mandrel (29) also allows the spring loaded lower lock segments (31) to extend in a radially outward direction, thereby preventing the locking mandrel (29) from ever expanding the collapsed arm segments on collet mandrel (28) enough to reengage the service assembly to the gravel pack packer. Furthermore, as piston (15) is pumped backed uphole, return lock keys (65) will extend radially inward once the keys clear locking collet (9). In the extended position, return lock keys (65) prevent piston (15) from moving back downhole. The rotational lock and the lower preset lock will not be reactivated because locking mandrel (29) will be engaged with release mandrel (25), thus preventing the release mandrel from moving back upward. Accordingly, the slots (25*b*) on release mandrel (25) will not re-engage lugs (26*b*) on release collet (26), nor will shoulders (25*a*) move under and radially extend support members (26*a*). To prevent mechanical damage to collet (29*a*), shear ring (66) and shear screw (18) shear to allow piston (15) to stroke all the way up to the locked position. Thus, one embodiment of the invention provides an annulus release mechanism for releasing the service assembly from the gravel pack packer. The annulus release is activated by the application of annulus pressure to setting piston (15), which causes the piston to simply stroke back uphole.

The crossover tool may then be stroked through all gravel or frac pack positions to verify good operations before the gravel pack operations are commenced. During this sequence, sliding sleeve (82) is shifted to the open position by the sliding sleeve shifting tool (56). More particularly, when the service assembly is picked up, sliding sleeve (82) is in the closed position and the collet means on the shifting tool will pass through the sliding sleeve. Upon downward movement of the service assembly, the collet means on shifting tool (56) will engage the sliding sleeve and shift it to the open position.

Once the gravel pack packer has been set and the sliding sleeve (82) has been opened, gravel pack operations may be commenced in the usual manner. The gravel pack slurry is pumped down the workstring and into the internal passageway of the service assembly and will exit out gravel flow ports (42*a*) through ports (80) and into the annulus adjacent to the casing. The proppant in the gravel pack slurry will be deposited in the perforations and about the outer diameter of the gravel pack screens. When the service assembly is in the squeeze position as shown in FIG. 1, the carrier fluid of the gravel pack slurry is pumped through the perforations and into the formation. If a circulating gravel pack is desired, the service assembly is picked up until the upper flow ports (38*a*) clear the seal bore of the gravel pack packer. Once the flow ports (38*a*) have cleared the seal bore of the gravel pack packer, the carrier fluid of the gravel pack slurry may pass through the gravel pack screens and enter through the mule shoe on the bottom of the service assembly, enter into the flow port of the concentric check valve, displace the piston in the concentric check valve and continue up the annular space adjacent to the exterior of the crossover tool assembly and up through the crossover tool's longitudinal return flow passages and up the annular passageway adjacent the exterior of the flow tube, out flow ports (38) and into the annular space between the casing and the workstring above the gravel pack packer.

Gravel pack operations are terminated once a screen out occurs. A screen out occurs when it is no longer safe due to pressure constraints to continue pumping more gravel or proppant. When a screen out occurs it is possible that excess gravel or proppant is left inside the workstring and service assembly down to the gravel flow ports (42*a*). The excess gravel is typically reversed out of the workstring and upper portion of the service assembly prior to pulling the service assembly out of the wellbore. The excess gravel may be reversed out by applying pressure to the annulus above gravel pack packer (112). The service assembly is picked up until flow ports (42*a*) are exposed above gravel pack packer (112). The pressure differential causes a surge which comes in through the flow ports and allows an operator to circulate down the annulus and up through the flow ports to wash the proppant back up the workstring to the surface. During reversing operations, concentric check valve (53) is in the closed position and prevents fluid from flowing down the annular passageways which communicate with the longitudinal passageways in the crossover tool assembly.

Although the above description relates to a gravel packing operation, it will be understood that the single trip perforating and gravel packing system can also be used with frac packing operations.

The risk of prematurely setting the gravel pack packer by the pressure build up is reduced because of the configuration of the system. More particularly, pressure sensitive pistons have been eliminated from the annulus release tool, the preset lock and the rotational lock. In addition, since the tool utilizes only a large setting piston, the remaining mechanical components may be heavily shear pinned to prevent prematurely activating the system from the shock loads from the perforating guns.

Figure 11C:
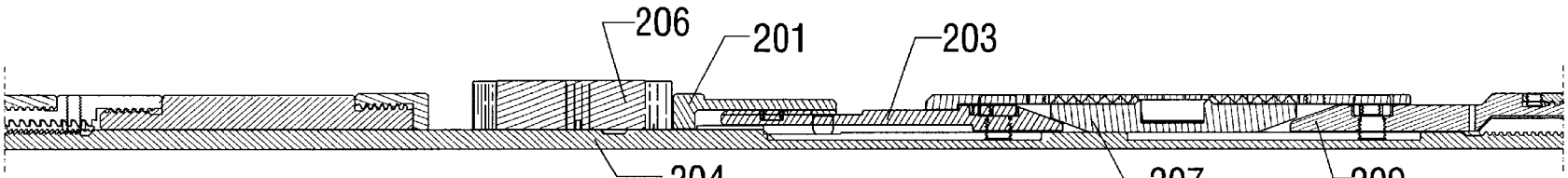
FIG. 11 A–C are cross sectional views of a packer slip preset lock for the retrievable gravel pack packer in the running, set and retrieved positions respectively.
Figure 11B:
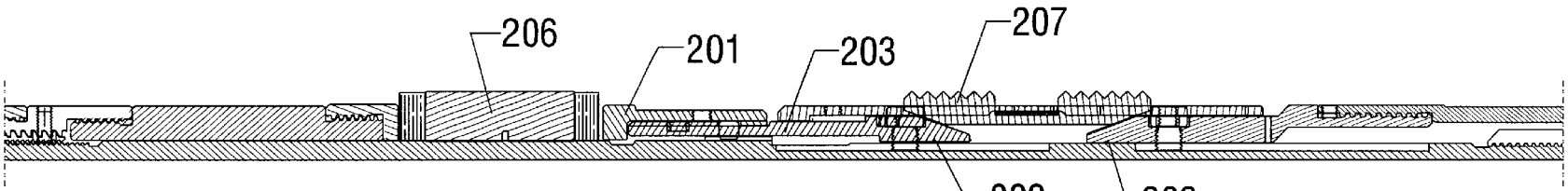
Figure 11A:
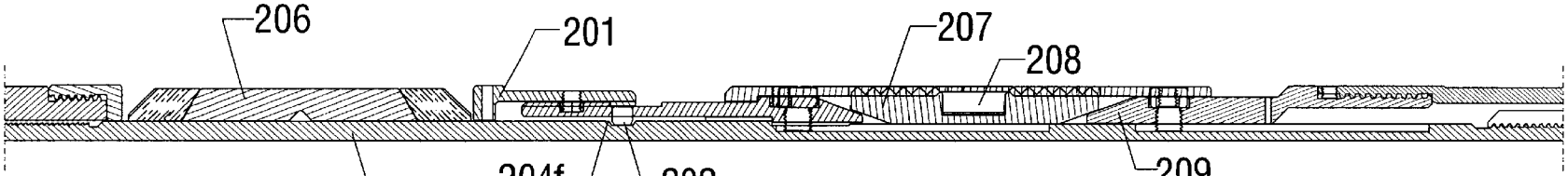

Another embodiment of the present invention includes a packer slip lock mechanism for the retrievable gravel pack packer (112). More particularly, the locking mechanism is built into the slip system which prevents the cones of the packer from moving underneath the slips. This lock mechanism not only prevents the slips from prematurely setting during run-in, but also prevents the slips from setting due to shock loads generated from the detonation of the perforating guns. The packer slip lock mechanism is shown in FIGS. 11A–C in the running, set and retrieved positions, respectively.

The packer slip lock mechanism may be used with commercially available retrievable gravel pack packers such as the BJ Services Model GPS-II packer. The packer slip lock mechanism may comprise lower gauge ring (201), upper cone (203) and one or more lock keys (202). In the running position, keys (202) extend into groove (204*f*) in the outer diameter of packer mandrel (204) to lock the upper cone (203) to the packer mandrel (204). The upper cone (203) engages cage (208) at shoulder (208*b*) to prevent cage (208) and slips (207) from moving down to lower cone (209). Lock keys (202) therefore prevent the upper cone (203) and lower cone (209) from wedging under slips (207). Keys (202) are retained in the locked position by lower gauge ring (201) so that the keys (202) will not disengage groove (204*f*). The lower gauge ring (201) is held in place by brass shear screws (205). The shear value of shear screws (205) must approximate the shear value of shear screws (212) on the lower portion of cage (208) so as not to prematurely compress packer element (206) which would create excessive friction against the internal diameter of the casing and may prevent the application of a sufficient setting force to allow slips (207) to adequately penetrate into the casing (225). The shear value of shear screws (205) must be high enough to prevent the perforating shock loads acting on lower gauge ring (201) from prematurely sifting down and uncovering keys (202).

Lower gauge ring (201) is maintained at a minimum mass to reduce the effect of shock waves on shear screws (205).

Preferably, the ratio of the shear value of shear screws (205) to weight of lower gauge ring (201) is sufficient to withstand the shock load from the detonation of the perforating gun. In a preferred embodiment, the shear value to weight ratio is between about 1500 pounds of shear value to one pound of mass to about 2500 pounds of shear value to one pound of mass, with a preferred ratio of about 2000 to 1. Holes **(201*h*) may be drilled into the lower gauge ring (201) to reduce its weight (mass) to obtain the preferred ratio. When packer (112) is being set, packing element (206) pushes lower gauge ring (201) downward, shearing shear screws (205) and uncovering keys (202). Keys (202) then release from groove (204*f*) and expand into the recess formed on the internal diameter of lower gauge ring (201). Once the lock keys have released, the upper cone (203), slip (207), and cage (208) move down towards lower cone (209). Shear screws (210) shear and allow upper cone (203) and lower cone (209) to expand slips (207)** radially to set the packer in the casing. Although, the packer slip lock mechanism is described with the single trip perforating and gravel pack system, it will be understood that the slip lock mechanism may be used with any packer application.

Figure 12:
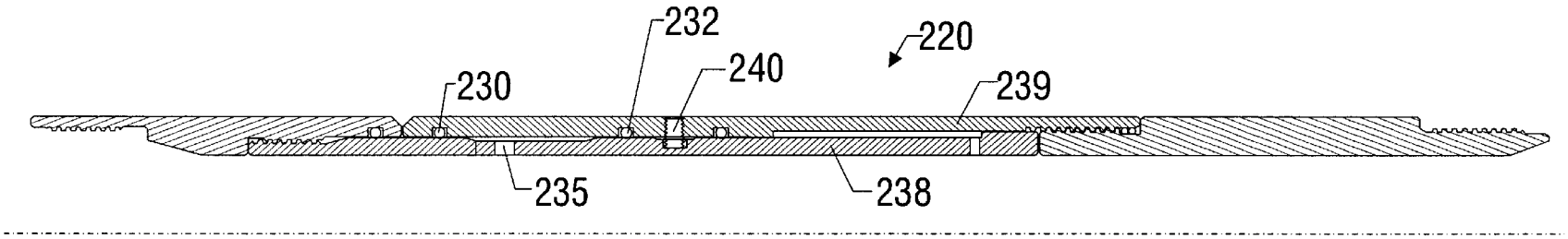
FIG. 12 is a cross sectional view of a balance valve for the retrievable service assembly.

In another embodiment of the invention, the single trip perforating and gravel pack system may also include a balance valve (220) as illustrated in FIG. 12. The balance valve (220) is attached to the bottom of washpipe (75) above lower seal assembly (116) in the retrievable service assembly. As such, the balance valve will be located immediately below gravel pack screens (94). The balance valve eliminates the potential for differential lock below the seal assembly in cases where there is no well communication with the formation below packer (104). The valve also acts to protect the washpipe from overpressuring during the fracturing operation. The valve is threadedly attached at its upper end to the bottom of washpipe (75). The lower end of the valve is threadedly attached to the top of the seal assembly (116). Seals (230) and (232) straddle port (235) to seal off the port. If differential locking is occurring when pulling the crossover tool up, the shear screws (240) will shear which allows valve mandrel (238) to move upward relative to outer cylinder (239) until port (235) moves beyond seal (230), thus uncovering port (235). Pressure differences will then equalizes above and below the valve to eliminate differential lock. The same will occur if frac pressure gets too high on the outside of the washpipe. The valve thus protects the washpipe from collapse which could stick the assembly.

While the present invention has been particularly shown and described with reference to various illustrative embodiments thereof, it will be understood by those skilled in the art that various changes in form and details may be made without departing from the spirit and scope of the invention. The above-described embodiments are illustrative and should not be considered as limiting the scope of the present invention.

What is claimed is:

1. A method for perforating and gravel packing a wellbore in a single trip comprising:

a) running a single trip perforating and gravel pack system into the wellbore on a workstring, the system comprising:

i) a completion assembly comprising a hydraulically set upper packer, a sliding sleeve assembly having one or more flow ports and a slidable sleeve shiftable to open or close the flow ports, an upper polished bore receptacle having an internal seal bore, a gravel pack screen, a lower polished bore receptacle having an internal seal bore and a lower packer;

ii) a perforating assembly connected to the lower packer, the perforating assembly comprising a firing head and a perforating gun;

iii) a retrievable service assembly comprising a hydraulic setting tool and a crossover tool assembly, the hydraulic setting tool being releasably connected to the upper packer and comprising a top sub adapted to be connected to the workstring on its upper end and an upper body on its lower end, a housing attached about the outer diameter of the upper body, wherein a setting piston and a locking assembly are enclosed within the housing, the locking assembly comprising a lock sleeve, one or more piston lock keys and a locking collet, wherein the lock sleeve is adapted for slidable movement along the internal surface of the upper body and includes a landing profile on its internal diameter, the landing profile being adapted to receive a shifting tool, wherein the piston lock keys are spaced about the outer diameter of the lock sleeve and are initially maintained in a locked position by the lock sleeve to lock the setting piston relative to the upper packer, a setting sleeve connected to the setting piston for setting the upper packer;

the crossover tool assembly is connected to the hydraulic setting tool and comprises an upper crossover mandrel having a plurality of radially extending flow ports, one or more upper seal units, a ported crossover sub having a plurality of gravel flow ports and a plurality of longitudinally extending return flow passages extending between the gravel flow ports, one or more lower seal units, a bypass tube, a check valve, a washpipe, a sliding sleeve shifting tool and a seal assembly wherein the return flow passages are in communication with the annular flow passageway extending between the bypass tube, upper seal units and the crossover mandrel and between the lower seal units and the washpipe;

b) positioning the perforating gun in the wellbore adjacent a production zone and setting the lower packer;

c) detonating the perforating gun;

d) unsetting the lower packer;

e) repositioning the system so the gravel pack screen is positioned adjacent the perforations;

f) resetting the lower packer;

g) landing a shifting tool in the lock sleeve of the hydraulic setting tool;

h) shifting the lock sleeve from a locked position to an unlocked position thereby releasing the piston lock keys from the setting piston; and i) applying hydraulic pressure to the setting piston to set the upper packer.

2. The method of claim 1 wherein the lock sleeve is secured to the inner surface of the upper body by shearable means and wherein the step of shifting the lock sleeve further comprises shearing the shear means.

3. The method of claim 2 further comprising pumping the shifting tool to the lock sleeve wherein the shifting tool comprises elastomeric fins positioned about an inner mandrel for providing 360° of wall contact with the inner sealing bores of the hydraulic setting tool.

4. The method of claim 3 further comprising applying pressure to the workstring until the force acting on the shifting tool exceeds the shear value of the shear means.

5. The method of claim 2 wherein the step of landing the shifting tool further comprises engaging the mating profile on the inner diameter of the lock sleeve with a plurality of spring loaded keys on the shifting tool.

6. The method of claim 5 further comprising releasing the shifting tool from the lock sleeve after the lock sleeve moves to the unlock position by compressing the spring loaded keys on the shifting tool with an internal shoulder in the hydraulic setting tool, thereby releasing the keys from the profile on the lock sleeve.

7. The method of claim 6 further comprising pumping the shifting tool to an internal landing profile beneath the gravel flow ports and engaging the internal landing profile with the locking keys on the shifting tool.

8. The method of claim 1 wherein the hydraulic setting tool includes a rotational lock for applying torque to the system, the rotational lock comprising an inner mandrel extending from the upper body, a release mandrel connected to the setting piston and a release collet, the release collet having a plurality of longitudinally extending fingers with enlarged support members on their ends for engaging an internal profile on the inner diameter of a packer setting sleeve and a plurality of radially extending lugs on the upper end of the release collet, the release mandrel having a plurality of arms with a radially extending shoulder on each arm for supporting the enlarged support members of the release collet when the support members are engaging the packer setting sleeve in the locked position and a matching number of slots for rotationally interlocking with the plurality of lugs on the release collet, wherein the step of applying pressure to the setting piston causes the piston to stroke downwardly disengaging the slots on the release mandrel from the lugs on the release collet thereby releasing the rotational lock in the hydraulic setting tool.

9. The method of claim 8 wherein the hydraulic setting tool further comprises an annulus release mechanism for releasing the service assembly from the completion assembly comprising a locking mandrel secured to the inner mandrel by shear means, and a collet mandrel having a plurality of longitudinally collapsible arm segments extending about its circumference wherein the locking mandrel in the running position support the arm segments to keep the arm segments engaged with threads on the upper packer, the method further comprising engaging the locking mandrel with the release mandrel.

10. The method of claim 9 further comprising applying annulus pressure to the setting piston to shear the shear means securing the locking mandrel to the inner mandrel and moving the setting piston and release mandrel upwardly, pulling the locking mandrel out from under the arm segments allowing the arm segments to collapse and release from the upper packer.

11. The method of claim 10 wherein the annulus release mechanism include a plurality of lock segments located in recesses in the outer diameter of the inner mandrel, the lock segments being biased radially outward and maintained in their unlocked position by the locking mandrel in the running position, further comprising moving the locking mandrel past the lock segments until the lock segments expand radially to prevent the collet mandrel from moving back under the collet arm segments.

12. The method of claim 11 further comprising shifting the sliding sleeve to open the flowports with the sliding sleeve shifting tool.

13. The method of claim 12 further comprising pumping a gravel pack slurry down the workstring, into the internal passageways of the service assembly, out the gravel flowports, through the flowports and into the annulus between the completion assembly and the wellbore casing, wherein the gravel pack slurry comprises a carrier fluid and proppant.

14. The method of claim 13 further comprising depositing the proppant of the gravel pack slurry in the perforations and about the gravel pack screen.

15. The method of claim 14 wherein the check valve is a concentric, donut-shaped check valve positioned in the annular flow passageway of the crossover tool assembly, the check valve comprising a valve retainer, a valve piston and a valve spring wherein the valve spring biases the valve piston in a closed position against the valve retainer, the valve retainer having a plurality of flowports in communication with the bore of the service assembly, the method further comprising circulating the carrier fluid of the gravel pack slurry through the gravel pack screen, through the bottom of the service assembly, into the flowports of the concentric check valve, wherein the return fluid flow overcomes the spring force exerted by the spring and moves the valve piston to the open position so that return fluid flow can flow through the check valve and up the flow passageway through the crossover tool assembly.

16. A single trip perforating and gravel pack system for perforating and gravel packing a wellbore comprising a completion assembly, a perforating assembly and a retrievable service assembly, wherein i) the completion assembly comprises a hydraulically set upper packer, a sliding sleeve assembly having one or more flow ports and a slidable sleeve shiftable to open or close the flow ports, an upper polished bore receptacle having an internal seal bore, a gravel pack screen, a lower polished bore receptacle having an internal seal bore and a lower packer;

ii) the perforating assembly, connected to the lower packer, comprises a firing head and a perforating gun;

iii) the retrievable service assembly comprising a hydraulic setting tool and a crossover tool assembly, wherein the hydraulic setting tool is releasably connected to the upper packer and comprises a top sub adapted to be connected to a workstring on its upper end and an upper body on its lower end, a housing attached about the outer diameter of the upper body, wherein a setting piston and a locking assembly are enclosed within the housing, the locking assembly comprising a lock sleeve, one or more piston lock keys and a locking collet, wherein the lock sleeve is adapted for slidable movement along the internal surface of the upper body and includes a landing profile on its internal diameter, the landing profile being adapted to receive a shifting tool, wherein the piston lock keys are spaced about the outer diameter of the lock sleeve and are initially maintained in a locked position by the lock sleeve to lock the setting piston relative to the upper packer, wherein the lock sleeve is adapted to be shifted to an unlocked position by a shifting tool whereby the piston lock keys release the setting piston, a setting sleeve connected to setting piston for setting the upper packer; and the crossover tool assembly is connected to the hydraulic setting tool and comprises an upper crossover mandrel having a plurality of radially extending flow ports, one or more upper seal units, a ported crossover sub having a plurality of gravel flow ports and a plurality of longitudinally extending return flow passages extending between the gravel flow ports, one or more lower seal units, a bypass tube, a check valve, a washpipe, a sliding sleeve shifting tool and a seal assembly wherein the return flow passages are in communication with the annular flow passageway extending between the bypass tube upper seal units and the crossover mandrel and between the lower seal units and the washpipe.

17. The apparatus of claim 16 wherein the lock sleeve is secured to the inner surface of the upper body by shearable means.

18. The apparatus of claim 16 further comprising a shifting tool having elastomeric fins positioned about an inner mandrel for providing 360° of wall contact with inner sealing bores of the hydraulic setting tool.

19. The apparatus of claim 16 wherein the hydraulic setting tool includes a rotational lock for applying torque to the system, the rotational lock comprising an inner mandrel extending from the upper body, a release mandrel connected to the setting piston and a release collet, the release collet having a plurality of longitudinally extending fingers with enlarged support members on their ends for engaging an internal profile on the inner diameter of a packer setting sleeve and a plurality of radially extending lugs on the upper end of the release collet, the release mandrel having a plurality of arms with a radially extending shoulder on each arm for supporting the enlarged support members of the release collet when the support members are engaging the packer setting sleeve in the locked position and a matching number of slots for rotationally interlocking with the plurality of lugs on the release collet wherein application of pressure to the setting piston will stroke the piston downwardly, disengaging the slots on the release mandrel from the lugs on the release collet thereby releasing the rotational lock on the hydraulic setting tool.

20. The apparatus of claim 16 wherein the hydraulic setting tool further comprises an annulus release mechanism for releasing the service assembly from the completion assembly comprising a locking mandrel secured to the inner mandrel by shear means, and a collet mandrel having a plurality of longitudinally collapsible arm segments extending about its circumference wherein the locking mandrel in the running position support arm segments to keep the arm segments engaged with threads on the upper packer, wherein the application of pressure to the setting piston will stroke the piston downwardly, engaging the locking mandrel with the release mandrel and, thereafter the application of annulus pressure to the setting piston will move the piston upwardly, pulling the locking mandrel out from under the arm segments to allow the arm segments to collapse and release from the upper packer.

21. The apparatus of claim 20 wherein the annulus release mechanism include a plurality of lock segments located in recesses in the outer diameter of inner mandrel, the lock segments being biased radially outward and maintained in their unlocked position by the locking mandrel in the running position wherein the upward movement of the locking mandrel past the lock segments allows the lock segments to expand radially to prevent the collet mandrel from moving back under the collet arm segments.

22. The apparatus of claim 16 wherein the check valve is a concentric, donut-shaped one way check valve positioned in the annular flow passageway of the crossover tool assembly, the check valve comprising a valve retainer, a valve piston and a valve spring wherein the valve spring biases the valve piston in a closed position against the valve retainer, the valve retainer having a plurality of flowports in communication with the bore of the service assembly, wherein circulation of the carrier fluid of the gravel pack slurry through the gravel pack screens, through the bottom of the service assembly, and into the flowports of the concentric check valve, will overcome the spring force exerted by the valve spring and move the valve piston to the open position so that return fluid flow can flow through the check valve and up the flow passageway through the crossover tool assembly.

23. The apparatus of claim 16 further comprising a packer slip lock means for the hydraulically set upper packer comprising a lower gauge ring, an upper cone, a lower cone and one or more lock keys, wherein in the locked position, the lower gauge ring is secured by shearable means to the upper cone so that the lock keys lock the upper cone to the packer mandrel, which prevent the upper cone and lower cone from wedging under the slips of the packer, the shear means being shearable by application of downward force on the lower gauge ring whereafter, the lower gauge ring will slide relative to the upper cone releasing the lock keys and allowing the upper cone and lower cone to wedge under the slips of the packer.

24. The apparatus of claim 23 wherein the ratio of the shear value of the shear means to the weight of the lower gauge ring is between about 1500 to 2500 pounds of shear value to one pound of mass.

25. The apparatus of claim 16 wherein the retrievable service assembly further comprises a balance valve attached between the bottom of the washpipe and above the lower seal units, the balance valve comprising a valve mandrel having one or more equalizing ports extending radially therethrough, an outer cylinder shearably attached about the valve mandrel and seals for sealing the equalizing ports when the balance valve is in the closed position, wherein the mandrel is longitudinally shiftable relative to the outer cylinder to an equalizing position wherein the equalizing ports are moved beyond the seals and allow the pressure inside the service assembly to equalize with pressure outside the service assembly.

26. A hydraulic setting tool for setting a packer in a wellbore, the setting tool comprising:

a top sub adapted to be connected to a workstring on its upper end and an upper body on its lower end, a housing attached about the outer diameter of the upper body, wherein a setting piston and a locking assembly are enclosed within the housing, the locking assembly comprising a lock sleeve, one or more piston lock keys and a locking collet, wherein the lock sleeve is adapted for slidable movement along the internal surface of the upper body and includes a landing profile on its internal diameter, the landing profile being adapted to receive a shifting tool, wherein the piston lock keys are spaced about the outer diameter of the lock sleeve and are initially maintained in a locked position by the lock sleeve to lock the setting piston relative to the packer, wherein the lock sleeve is adapted to be shifted to an unlocked position by a shifting tool whereby the piston lock keys release the setting piston, and a setting sleeve connected to a setting piston for setting the packer.

27. The apparatus of claim 26, wherein the lock sleeve is secured to the inner surface of the upper body by shearable means.

28. The apparatus of claim 26 further comprising a shifting tool having elastomeric fins positioned about an inner mandrel for providing 360° of wall contact with inner sealing bores of the hydraulic setting tool.

29. The apparatus of claim 26 wherein the hydraulic setting tool includes a rotational lock for applying torque to the system, the rotational lock comprising an inner mandrel extending from the upper body, a release mandrel connected to the setting piston and a release collet, the release collet having a plurality of longitudinally extending fingers with enlarged support members on their ends for engaging an internal profile on the inner diameter of a packer setting sleeve and a plurality of radially extending lugs on the upper end of the release collet, the release mandrel having a plurality of arms with a radially extending shoulder on each arm for supporting the enlarged support members of the release collet when the support members are engaging the packer setting sleeve in the locked position and a matching number of slots for rotationally interlocking with the plurality of lugs on the release collet wherein application of pressure to the setting piston will stroke the piston downwardly, disengaging the slots on the release mandrel from the lugs on the release collet thereby releasing the rotational lock on the hydraulic setting tool.

30. The apparatus of claim 26 wherein the hydraulic setting tool further comprises an annulus release mechanism for releasing the service assembly from the completion assembly comprising a locking mandrel secured to the inner mandrel by shear means, and a collet mandrel having a plurality of longitudinally collapsible arm segments extending about its circumference wherein the locking mandrel in the running position support the arm segments to keep the arm segments engaged with threads on the upper packer, wherein the application of pressure to the setting piston will strike the piston downwardly, engaging the locking mandrel with the release mandrel and, thereafter the application of annulus pressure to the setting piston will move the piston upwardly, pulling the locking mandrel out from under the arm segments to allow the arm segments to collapse and release from the upper packer.

31. The apparatus of claim 30 wherein the annulus release mechanism includes a plurality of lock segments located in recesses in the outer diameter of the inner mandrel, the lock segments being biased radially outward and maintained in their unlocked position by the locking mandrel in the running position wherein the upward movement of the locking mandrel past the lock segments allows the lock segments to expand radially to prevent the collet mandrel from moving back under the collet arm segments.

32. The apparatus of claim 26 further comprising a packer slip lock means for the hydraulically set packer comprising a lower gauge ring, an upper cone, a lower cone and one or more lock keys, wherein in the locked position, the lower gauge ring is secured by shearable means to the upper cone so that the lock keys lock the upper cone to the packer mandrel, which prevent the upper cone and lower cone from wedging under the slips of the packer, the shear means being shearable by application of downward force on the lower gauge ring whereafter, the lower gauge ring will slide relative to the upper cone releasing the lock keys and allowing the upper cone and lower cone to wedge under the slips of the packer.

33. The apparatus of claim 32 wherein the ratio of the shear value of the shear means to the weight of the lower gauge ring is between about 1500 to 2500 pounds of shear value to one pound of mass.

* * * * *